US008518625B2

(12) United States Patent
Fukao et al.

(10) Patent No.: US 8,518,625 B2
(45) Date of Patent: Aug. 27, 2013

(54) TONER, IMAGE FORMING APPARATUS, IMAGE FORMING METHOD AND PROCESS CARTRIDGE

(75) Inventors: Tomohiro Fukao, Osaka (JP); Takuya Kadota, Hyogo (JP); Chieko Yamazaki, Shizuoka (JP); Yoshihiro Mikuriya, Hyogo (JP); Tsuyoshi Nozaki, Osaka (JP); Yoshimichi Ishikawa, Hyogo (JP); Atsushi Yamamoto, Shizuoka (JP); Kazuoki Fuwa, Hyogo (JP); Tomoharu Miki, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 95 days.

(21) Appl. No.: 13/113,576

(22) Filed: May 23, 2011

(65) Prior Publication Data

US 2011/0287356 A1 Nov. 24, 2011

(30) Foreign Application Priority Data

May 24, 2010 (JP) ..... 2010-118075

(51) Int. Cl.
*G03G 9/087* (2006.01)

(52) U.S. Cl.
USPC ..... 430/109.4; 430/108.1; 430/109.1; 430/110.1; 430/110.3

(58) Field of Classification Search
USPC ..... 430/108.1, 109.1, 109.4, 110.1, 110.3
See application file for complete search history.

(56) References Cited

U.S. PATENT DOCUMENTS

| | | | |
|---|---|---|---|
| 4,950,573 | A | 8/1990 | Yamaguchi et al. |
| 5,770,342 | A | 6/1998 | Okae et al. |
| 5,783,352 | A | 7/1998 | Okae et al. |
| 7,550,242 | B2 | 6/2009 | Nozaki et al. |
| 7,556,904 | B2 | 7/2009 | Kadota et al. |
| 7,556,906 | B2 | 7/2009 | Katoh et al. |
| 7,587,159 | B2 | 9/2009 | Fuwa et al. |
| 7,632,619 | B2 | 12/2009 | Mikuriya et al. |
| 7,635,549 | B2 | 12/2009 | Nakamura et al. |
| 7,678,522 | B2 | 3/2010 | Nakamura et al. |
| 7,695,885 | B2 | 4/2010 | Yasunaga et al. |

(Continued)

FOREIGN PATENT DOCUMENTS

| | | |
|---|---|---|
| JP | 9-258480 | 10/1997 |
| JP | 2750853 | 2/1998 |

(Continued)

OTHER PUBLICATIONS

U.S. Appl. No. 13/084,120, filed Apr. 11, 2011, Kadota, et al.

(Continued)

*Primary Examiner* — Peter Vajda
(74) *Attorney, Agent, or Firm* — Oblon, Spivak, McClelland, Maier & Neustadt, L.L.P.

(57) ABSTRACT

An electrostatic image developing toner including toner core particles each containing at least a first resin and a colorant, and fine resin particles formed of a second resin, wherein part of each of the fine resin particles is embedded in each of the toner core particles, and the remaining part of the fine resin particle is exposed on a surface of the toner core particle to form a protrusion, and wherein when a rate of the part of the fine resin particle to the fine resin particle is indicated by an embedment rate, an average of the embedment rates in the fine resin particles is 40% to 80%.

18 Claims, 6 Drawing Sheets

SEM Image in Ex. 1

SEM Image in Comp. Ex. 1

(56) References Cited

U.S. PATENT DOCUMENTS

| | | | |
|---|---|---|---|
| 7,709,171 | B2 | 5/2010 | Yamamoto et al. |
| 7,720,428 | B2 | 5/2010 | Hagi et al. |
| 7,727,694 | B2 | 6/2010 | Murakami et al. |
| 7,749,671 | B2 | 7/2010 | Yamamoto et al. |
| 7,785,760 | B2 | 8/2010 | Yamamoto et al. |
| 7,811,735 | B2 | 10/2010 | Nakamura et al. |
| 7,817,946 | B2 | 10/2010 | Murakami et al. |
| 7,820,348 | B2 | 10/2010 | Hagi et al. |
| 7,829,254 | B2 | 11/2010 | Kurose et al. |
| 7,833,686 | B2 | 11/2010 | Kadota et al. |
| 7,838,193 | B2 | 11/2010 | Hagi et al. |
| 7,867,680 | B2 | 1/2011 | Mikuriya et al. |
| 7,867,682 | B2 | 1/2011 | Nozaki et al. |
| 7,867,685 | B2 | 1/2011 | Murakami et al. |
| 7,873,300 | B2 | 1/2011 | Fuwa et al. |
| 7,903,998 | B2 | 3/2011 | Matsumoto et al. |
| 2004/0115553 | A1 | 6/2004 | Yamanouchi et al. |
| 2006/0160007 | A1* | 7/2006 | Kmiecik-Lawrynowicz et al. ... 430/108.3 |
| 2007/0026335 | A1 | 2/2007 | Yamamoto et al. |
| 2007/0031752 | A1* | 2/2007 | Watanabe et al. ..... 430/124 |
| 2007/0207399 | A1 | 9/2007 | Kadota et al. |
| 2007/0212630 | A1 | 9/2007 | Yasunaga et al. |
| 2007/0217842 | A1 | 9/2007 | Kato et al. |
| 2007/0218384 | A1 | 9/2007 | Matsumoto et al. |
| 2007/0218390 | A1 | 9/2007 | Nozaki et al. |
| 2007/0238042 | A1 | 10/2007 | Yasunaga et al. |
| 2008/0069608 | A1 | 3/2008 | Katoh et al. |
| 2008/0069617 | A1 | 3/2008 | Matsumoto et al. |
| 2008/0070149 | A1 | 3/2008 | Kato et al. |
| 2008/0076054 | A1 | 3/2008 | Nozaki et al. |
| 2008/0096119 | A1 | 4/2008 | Yamamoto et al. |
| 2008/0101823 | A1 | 5/2008 | Katoh et al. |
| 2008/0131797 | A1 | 6/2008 | Ishikawa et al. |
| 2008/0153018 | A1 | 6/2008 | Mikuriya et al. |
| 2008/0159777 | A1 | 7/2008 | Fuwa et al. |
| 2008/0175630 | A1 | 7/2008 | Yasunaga et al. |
| 2008/0176159 | A1 | 7/2008 | Matsumoto et al. |
| 2008/0187854 | A1* | 8/2008 | Yoshida et al. ..... 430/109.4 |
| 2008/0220357 | A1 | 9/2008 | Nozaki et al. |
| 2008/0226356 | A1 | 9/2008 | Yasunaga et al. |
| 2008/0227001 | A1 | 9/2008 | Kadota et al. |
| 2008/0227009 | A1 | 9/2008 | Fuwa et al. |
| 2008/0227013 | A1 | 9/2008 | Kadota et al. |
| 2008/0227016 | A1 | 9/2008 | Nozaki et al. |
| 2008/0233497 | A1 | 9/2008 | Yamamoto et al. |
| 2008/0233506 | A1 | 9/2008 | Hagi et al. |
| 2008/0233510 | A1 | 9/2008 | Nozaki et al. |
| 2008/0233511 | A1 | 9/2008 | Ishikawa et al. |
| 2008/0279591 | A1 | 11/2008 | Yasunaga et al. |
| 2008/0304875 | A1 | 12/2008 | Katoh et al. |
| 2009/0017391 | A1 | 1/2009 | Yamamoto et al. |
| 2009/0052952 | A1 | 2/2009 | Katoh et al. |
| 2009/0117481 | A1 | 5/2009 | Yasunaga et al. |
| 2009/0162772 | A1 | 6/2009 | Fuwa et al. |
| 2009/0169270 | A1 | 7/2009 | Fuwa et al. |
| 2009/0186289 | A1 | 7/2009 | Nakamura et al. |
| 2009/0220879 | A1 | 9/2009 | Matsumoto et al. |
| 2009/0232542 | A1 | 9/2009 | Yamamoto et al. |
| 2009/0233199 | A1 | 9/2009 | Nozaki et al. |
| 2009/0257792 | A1 | 10/2009 | Nakamura et al. |
| 2009/0297975 | A1 | 12/2009 | Ishikawa et al. |
| 2009/0297976 | A1 | 12/2009 | Yamamoto et al. |
| 2010/0009282 | A1 | 1/2010 | Katoh et al. |
| 2010/0055603 | A1 | 3/2010 | Nozaki et al. |
| 2010/0068646 | A1 | 3/2010 | Yamamoto |
| 2010/0227265 | A1 | 9/2010 | Matsumoto et al. |
| 2010/0239974 | A1 | 9/2010 | Nozaki et al. |
| 2010/0272481 | A1 | 10/2010 | Yamamoto et al. |
| 2010/0296848 | A1 | 11/2010 | Yamamoto et al. |
| 2011/0045401 | A1 | 2/2011 | Murakami et al. |
| 2011/0053063 | A1 | 3/2011 | Kadota et al. |
| 2011/0053071 | A1 | 3/2011 | Miki et al. |
| 2011/0053077 | A1 | 3/2011 | Mikuriya et al. |
| 2011/0164901 | A1 | 7/2011 | Yamamoto et al. |

FOREIGN PATENT DOCUMENTS

| | | |
|---|---|---|
| JP | 2838410 | 10/1998 |
| JP | 2001-175025 | 6/2001 |
| JP | 2007-3840 | 1/2007 |
| JP | 2008-90256 | 4/2008 |
| JP | 2008-233430 | 10/2008 |
| JP | 4298966 | 4/2009 |
| JP | 2011-95286 | 5/2011 |

OTHER PUBLICATIONS

Extended Search Report issued Aug. 30, 2011 in European Patent Application No. 11167124.4-1217.

* cited by examiner

SEM Image in Ex. 1

SEM Image in Comp. Ex. 1

TONER, IMAGE FORMING APPARATUS, IMAGE FORMING METHOD AND PROCESS CARTRIDGE

BACKGROUND OF THE INVENTION

1. Field of the Invention

The present invention relates to an electrostatic image developing toner for developing a latent electrostatic image formed in an electrophotographic method, an electrostatic recording method and an electrostatic printing method, a toner container containing the toner, a developer, an image forming apparatus, an image forming method and a process cartridge.

2. Description of the Related Art

Dry-process developing units using a powdery developing agent have widely been employed in image forming apparatuses such as electronic copiers, printers and facsimiles, in which a latent electrostatic image formed on a latent image bearing member is visualized with a developer to obtain a recorded image.

In recent years, color image forming apparatuses using electrophotographic process have broadly been employed, and digitized images are easily available. Thus, it is required to make an image to be printed at higher definition. While studying higher resolution and gradation of an image, as an improvement of a toner which visualizes a latent image, it has been studied to further conglobate and minimize in particle size for forming the image at high definition. And, since in the toners produced by the pulverizing methods, their conglobation and minimization are limited, so-called polymerized toners produced by a suspension polymerization method, an emulsification polymerization method and a dispersion polymerization method capable of conglobating and minimizing in particle size have been being employed.

Polymerization toners have a small particle diameter and thus, exhibit an increased adhesion force to members, which degrades transfer efficiency and causes filming. Also, the polymerization toners have a spherical shape and thus, are poor in cleanability. In addition, the polymerization methods allow toner materials of relatively low resistance to be localized near the toner surfaces. Therefore, the formed polymerization toners involve background smear due to their low chargeability. Meanwhile, in recent years, there has been increased demand for toners that attain high-quality images and have low-temperature fixing property for energy saving. Thus, a binder resin having a low melt temperature is desirably used. However, toners having a low-temperature fixing property possess newly arising problems such as generation of blocking at high-temperature, high-humidity environment, which is associated with degradation in heat resistance storage stability.

In view of this, attempts have been made to modify the surfaces of toner core particles to solve the aforementioned problems. The method for surface modification is, for example, dry methods in which fine particles are made to adhere onto the toner surfaces by the action of mechanical impact, and wet methods in which a resin dispersing agent is added to a dispersion liquid containing toner particles dispersed in a solvent, wherein the resin of the resin dispersing agent is different from the resin forming the toner particles. Regarding the dry methods, Japanese Patent (JP-B) No. 2838410 or other literatures disclose a toner including base particles and fine particles embedded in the surfaces thereof, wherein the toner is produced by adding the fine particles to the base particles heated to a temperature near their softening point, followed by stirring and mixing. Also, JP-B No. 2750853 discloses a toner including fine resin particles and toner core particles which are covered with the fine resin particles by the action of mechanical impact. In these dry methods, the fine particles are ununiform and thus cannot be attached on the toner surfaces sufficiently. As a result, the fine particles are exfoliated to cause problems such as filming and adhesion.

Regarding the wet methods, Japanese Patent Application Laid-Open (JP-A) No. 2008-090256 or other literatures disclose a method in which the surfaces of toner core particles formed of first resin particles and a colorant are partially or totally covered with second resin particles. However, according to this method, the toner core particles are covered with the second resin particles so sparsely and ununiformly that background smear and storage stability cannot be sufficiently improved, although cleanability is improved. In addition, degradation of transferability occurs.

JP-A No. 2008-233430 or other literatures disclose a toner including toner core particles and convex portions with an average diameter of 100 nm to 500 nm which are provided on the surfaces of the toner core particles, wherein the toner core particles are covered with the convex portions at a coverage rate of 10% to 80%. However, according to the production method described in Examples, the protrusions of the toner are not uniform in size, and thus the toner cannot solve problems such as background smear. The binder resin forming the convex portions has high polarity to greatly change depending on the environment and thus, is insufficient in improvement of heat resistance storage stability.

JP-A No. 2003-202701 or other literatures disclose a method in which fine resin particles are added in advance to an aqueous phase for fusion to control the particle diameter. However, in this method, the fine resin particles are incorporated into toner core particles, and as a result, the toner core particles cannot be covered with the fine resin particles in such an amount that heat resistance storage stability is improved.

According to JP-A No. 09-258480, cores are totally covered with shell layers, leading to considerable degradation of fixing property.

Presumably, toners or toner-containing cartridges are transported under application of a certain pressure. Thus, simply by increasing the glass transition temperature of the toner particle surface through surface modifications, the toner unavoidably deforms due to pressure at a high-temperature, high-humidity environment. Therefore, care should be taken on the glass transition temperature of the toner core particles. It cannot be stated that any of the above patent literatures can attain both desired low-temperature fixing property and desired heat resistance storage stability under application of a certain pressure. For example, JP-A Nos. 2001-175025 and 2007-003840 made attempts to improve heat resistance storage stability using fine resin particles. However, since the glass transition temperature of toner core particles is low, the toner deforms due to application of pressure, indicating that only fine resin particles existing in the outer layer cannot improve storage stability under application of pressure.

BRIEF SUMMARY OF THE INVENTION

The present invention solves the above existing problems and aims to achieve the following objects. That is, the present invention aims to provide a dry electrostatic image developing toner that is excellent in chargeability, developing durability, adhesion resistance, transferability, cleanability, heat resistance storage stability and low-temperature fixing property and that can form high-quality images; a toner container containing the toner; a developer; an image forming apparatus; an image forming method; and a process cartridge.

The present inventors conducted extensive studies to solve the above existing problems, and have found that the above aim is achieved by forming a dry electrostatic image developing toner, which contains at least a binder resin and a colorant, using toner core particles formed of a first resin and protrusions formed of a second resin embedded in the surfaces of the toner core particles so that when rates of the protrusions embedded in the toner core particles are indicated by embedment rates, an average of the embedment rates is 40% to 80%. The present invention has been accomplished on the basis of this finding.

The present invention is based on the above finding obtained by the present inventors. Means for solving the above existing problems are as follows.

<1> An electrostatic image developing toner including:

toner core particles each containing at least a first resin and a colorant, and fine resin particles formed of a second resin, wherein part of each of the fine resin particles is embedded in each of the toner core particles, and the remaining part of the fine resin particle is exposed on a surface of the toner core particle to form a protrusion, and wherein when a rate of the part of the fine resin particle to the fine resin particle is indicated by an embedment rate, an average of the embedment rates in the fine resin particles is 40% to 80%.

<2> The electrostatic image developing toner according to <1>, wherein a standard deviation of the embedment rates is 10 or less.

<3> The electrostatic image developing toner according to <1> or <2>, wherein the fine resin particles have an average sphericity of 0.90 or more.

<4> The electrostatic image developing toner according to any one of <1> to <3>, wherein an amount of the fine resin particles is 1% by mass to 20% by mass relative to the electrostatic image developing toner.

<5> The electrostatic image developing toner according to any one of <1> to <4>, wherein the first resin is a polyester resin.

<6> The electrostatic image developing toner according to any one of <1> to <5>, wherein the first resin has an acid value of 2 mgKOH/g to 25 mgKOH/g.

<7> The electrostatic image developing toner according to any one of <1> to <6>, wherein the second resin is a vinyl resin.

<8> The electrostatic image developing toner according to any one of <1> to <7>, wherein an amount of a styrene monomer among monomers forming the second resin is 80% by mass to 100% by mass.

<9> The electrostatic image developing toner according to any one of <1> to <8>, wherein an amount of an acid monomer among the monomers forming the second resin is 0% by mass.

<10> The electrostatic image developing toner according to any one of <1> to <9>, wherein the first resin has a glass transition temperature Tg1 which satisfies expression (1) below:

$$45^\circ\,C. \leqq Tg1 \leqq 70^\circ\,C. \quad (1)$$

<11> The electrostatic image developing toner according to any one of <1> to <10>, wherein the second resin has a glass transition temperature Tg2 which satisfies expression (2) below:

$$45^\circ\,C. \leqq Tg2 \leqq 100^\circ\,C. \quad (2)$$

<12> The electrostatic image developing toner according to any one of <1> to <11>, wherein the toner core particles each further contain a modified polyester resin containing a urethane group, a urea group or both of the groups.

<13> The electrostatic image developing toner according to any one of <1> to <12>, wherein the toner core particles each further contain a releasing agent.

<14> The electrostatic image developing toner according to any one of <1> to <13>, wherein the electrostatic image developing toner further contains as an additive fine silica particles whose surfaces have been hydrophobized.

<15> The electrostatic image developing toner according to any one of <1> to <14>, wherein the electrostatic image developing toner is obtained through a process including producing the toner core particles, and attaching and fusing the fine resin particles on the surfaces of the toner core particles.

<16> The electrostatic image developing toner according to <15>, wherein the toner core particles are obtained through granulation performed by emulsifying or dispersing, in an aqueous medium, an oil phase containing at least the colorant and the first resin, a precursor of the first resin, or both of the first resin and the precursor.

<17> The electrostatic image developing toner according to <16>, wherein the electrostatic image developing toner is obtained by adding an aqueous dispersion liquid of the fine resin particles to the aqueous medium containing the toner core particles emulsified or dispersed therein, to attach and fuse the fine resin particles to the surfaces of the toner core particles.

<18> A toner container including:

the electrostatic image developing toner according to any one of <1> to <17>, and a container, which houses the electrostatic image developing toner.

<19> A developer including:

the electrostatic image developing toner according to any one of <1> to <17>.

<20> An image forming apparatus including:

a latent image bearing member which bears a latent image thereon, a charging unit configured to uniformly charge a surface of the latent image bearing member, an exposing unit configured to expose the charged surface of the latent image bearing member based on image data to form a latent electrostatic image, a toner for visualizing the latent image, a developing unit configured to develop, with the toner, the latent electrostatic image formed on the surface of the latent image bearing member to form a visible image, a transfer unit configured to transfer, onto an image-receiving medium, the visible image on the surface of the latent image bearing member, and a fixing unit configured to fix the visible image on the image-receiving medium, wherein the toner is the electrostatic image developing toner according to any one of <1> to <17>.

<21> An image forming method including:

uniformly charging a surface of a latent image bearing member, exposing the charged surface of the latent image bearing member based on image data to form a latent electrostatic image, developing, with a toner, the latent electrostatic image formed on the surface of the latent image bearing member to form a visible image, transferring, onto an image-receiving medium, the visible image on the surface of the latent image bearing member, and fixing the visible image on the image-receiving medium, wherein the toner is the electrostatic image developing toner according to any one of <1> to <17>.

<22> A process cartridge including:

a latent image bearing member, a developing unit configured to develop, with a toner, a latent electrostatic image formed on a surface of the latent image bearing member to form a visible image, the latent image bearing member and the developing unit being integrally supported in the process cartridge which is mounted detachably to an image forming apparatus, wherein the toner is the electrostatic image developing toner according to any one of <1> to <17>.

According to the present invention, by adjusting the embedment rates of the protrusions in the toner surfaces to fall within a specific range, the above existing problems can be solved to achieve the above aim. That is, the present invention can provide an electrostatic image developing toner that is excellent in chargeability, developing durability, adhesion resistance, transferability, cleanability, heat resistance storage stability and low-temperature fixing property and that can form high-quality images; a toner container containing the toner; a developer; an image forming apparatus; an image forming method; and a process cartridge.

DETAILED DESCRIPTION OF THE INVENTION (Toner)

Figure 1A:
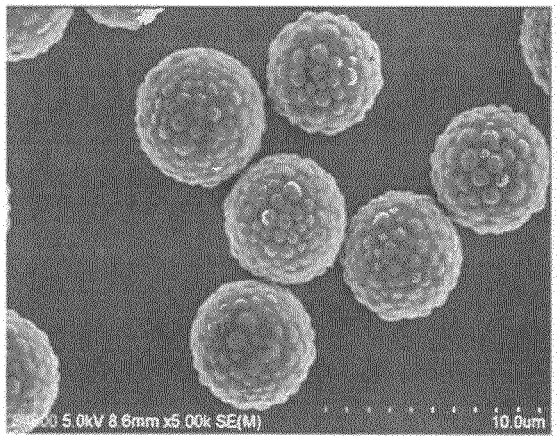
FIG. 1A is a SEM image of the toner of Example 1.

An electrostatic image developing toner of the present invention (hereinafter may be referred to simply as "toner") includes toner core particles containing at least a first resin and a colorant and fine resin particles formed of a second resin; and, if necessary, further includes appropriately selected other components.

In the toner of the present invention, it is necessary that parts of the fine resin particles are embedded in the toner core particles, and the remaining parts of the fine resin particles are exposed on surfaces of the toner core particles to form protrusions and, when rates of the parts of the fine resin particles to the fine resin particles are indicated by embedment rates, an average of the embedment rates is 40% to 80%. The toner having such protrusions can form high-quality images. For the following reasons, the protrusions are thought to exhibit such advantageous effects.

In one surface modification of the toner, when the toner surfaces are covered with protrusions formed of a resin different from that forming the toner core particles thereof, exudation of a releasing agent is maintained high, to thereby suppress an increase in the fixing temperature and improve the toner in chargeability, developing durability, adhesion resistance, transferability, cleanability and heat resistance storage stability. In addition, when an average of the embedment rates of the fine resin particles is adjusted to 40% to 80%, the protrusions are not exfoliated from the toner surfaces to maximally exhibit the effects obtained by surface modification for a long period of time.

If necessary, the toner of the present invention may contain external additives for improving flowability, developability and chargeability in addition to toner base particles containing the toner core particles and the fine resin particles partially embedded in the surfaces of the toner core particles.

The toner core particles contains, as essential ingredients, at least a binder resin and a colorant; and, if necessary, further contains other ingredients such as a releasing agent, a charge controlling agent and a plastisizer.

The first resin is used as a binder of the toner core particles. Then, the protrusions formed of the second resin are formed in the surfaces of the toner core particles, to thereby improve cleanability and heat resistance storage stability while maintaining satisfactory low-temperature fixing property of the toner. Also, an average of the embedment rates of the fine resin particles is adjusted to fall within the above specific range, to thereby improve chargeability, developing durability, adhesion resistance, cleanability and heat resistance storage stability and form high-quality images, while maintaining satisfactory low-temperature fixing property.

In the toner of the present invention, the protrusions of the second resin exposed on the surfaces of the toner core particles of the first resin can be formed by embedding parts of the fine resin particles of the second resin in the surfaces of the toner core particles and exposing the remaining parts of the fine resin particles on the surfaces of the toner core particles.

<Fine Resin Particles>

The fine resin particles are not particularly limited, so long as they are made of the second resin, and may be appropriately selected depending on the intended purpose. Preferably, the fine resin particles are dispersed in the aqueous medium before use. The resin of the fine resin particles is not particularly limited and may be appropriately selected depending on the intended purpose. Examples thereof include vinyl resins, polyesters, polyurethanes, polyureas and epoxy resins. Of these, vinyl resins are preferred from the viewpoint of easily obtaining the fine resin particles dispersed in the aqueous medium. Examples of the method for preparing aqueous dispersoids of vinyl fine resin particles include known polymerization methods such as an emulsification aggregation method, a suspension polymerization method and a dispersion polymerization method. Of these, an emulsification aggregation method is particularly preferred from the viewpoint of easily obtaining particles having a particle diameter suitable for the present invention.

<<Vinyl Fine Resin Particles>>

The vinyl fine resin particles used in the present invention contain a vinyl resin obtained through polymerization of a monomer mixture containing at least a styrene monomer.

In order for the toner obtained in the present invention to be used as charged functional particles like latent electrostatic image developing toner particles, the toner preferably has an easily chargeable surface. Therefore, in the monomer mixture, the amount of the styrene monomer, which has electron orbitals where electrons can stably travel as can be seen in aromatic ring structures, is not particularly limited and may be appropriately selected depending on the intended purpose, but preferably 50% by mass to 100% by mass, more preferably 80% by mass to 100% by mass, particularly preferably 95% by mass to 100% by mass. When the amount of the styrene monomer is less than 50% by mass, the obtained toner is poor in chargeability, which imposes limitation on applications of the toner.

Here, the styrene monomer refers to an aromatic compound having a vinyl polymerizable functional group. The vinyl polymerizable functional group is not particularly limited and may be appropriately selected depending on the intended purpose. Examples thereof include a vinyl group, an isopropenyl group, an allyl group, an acryloyl group and a methacryloyl group.

Specific examples of the styrene monomer include styrene, α-methylstyrene, 4-methylstyrene, 4-ethylstyrene, 4-tert-butylstyrene, 4-methoxystyrene, 4-ethoxystyrene, 4-carboxystyrene and metal salts thereof; 4-styrenesulfonic acid and metal salts thereof; 1-vinylnaphthalene, 2-vinylnaphthalene, allylbenzene, phenoxyalkylene glycol acrylate, phenoxyalkylene glycol methacrylate, phenoxypolyalkylene glycol acrylates and phenoxypolyalkylene glycol methacrylates. Of these, preferably, styrene is mainly used since it is easily available, and has excellent reactivity and high chargeability.

Also, in the monomer mixture, the amount of an acid monomer used in the vinyl resin of the present invention is not particularly limited and may be appropriately selected depending on the intended purpose. The amount thereof is preferably 0% by mass to 7% by mass, more preferably 0% by mass to 4% by mass, particularly preferably 0% by mass; i.e., no acid monomer is contained. When the amount thereof exceeds 7% by mass, the obtained vinyl fine resin particles themselves have high dispersion stability. Thus, when such vinyl fine resin particles are added to the dispersion liquid containing oil droplets dispersed in the aqueous phase, they are difficult to attach thereonto at ambient temperature. Or, even when the vinyl fine resin particles have been attached thereonto, they tend to be exfoliated through the process of solvent removal, washing, drying and treating with external additives. Whereas when the amount thereof is 4% by mass or less, the obtained toner less changes in chargeability depending on the working environment, which is advantageous.

Here, the acid monomer refers to a compound having an acid group in addition to the vinyl polymerizable functional group. The acid group is not particularly limited and may be appropriately selected depending on the intended purpose. Examples thereof include carboxylic acid, sulfonic acid and phosphoric acid.

The acid monomer is not particularly limited and may be appropriately selected depending on the intended purpose. Examples thereof include carboxyl group-containing vinyl monomers and salts thereof (e.g., (meth)acrylic acid, maleic acid or maleic anhydride, monoalkyl maleates, fumaric acid, monoalkyl fumarates, crotonic acid, itaconic acid, monoalkyl itaconate, glycol itaconate monoethers, citraconic acid, monoalkyl citraconates and cinnamic acid), sulfonic acid group-containing vinyl monomers and salts thereof, vinyl-based sulfuric acid monoesters and salts thereof, and phosphoric acid group-containing vinyl monomers and salts thereof. Of these, preferred are (meth)acrylic acid, maleic acid or maleic anhydride, monoalkyl maleates, fumaric acid and monoalkyl fumarates.

Also, a monomer having an ethylene oxide (EO) chain may be used for controlling compatibility to the toner core particles. Non-limitative examples thereof include methoxy polyethylene glycol methacrylates and methoxy polyethylene glycol acrylates such as methoxy nonadiethylene glycol methacrylate, methoxy octadecadiethylene glycol methacrylate, methoxy tricosadiethylene glycol methacrylate; and phenoxy polyethylene glycol methacrylates and phenoxy polyethylene glycol acrylates such as phenoxy nonadiethylene glycol acrylate, phenoxy octacosadiethylene glycol acrylate and phenoxy tetracontadiethylene glycol methacrylate. These monomers are obtained through esterification between polyethylene glycols and vinyl monomers having carboxylic acid. Commercially available products of these monomers include NK ester M-90G ($R1=CH_3$, $R2=CH_3$ and n=9), NK ester M-230G ($R1=CH_3$, $R2=CH_3$ and n=23) and NK ester AM-90G (R1=H, $R2=CH_3$ and n=9) (these products are of Shin-Nakamura Chemical Co., Ltd.).

The amount of the EO chain-containing monomer used is 30% by mass or less, preferably 25% by mass or less, more preferably 20% by mass or less, relative to the total amount of the monomers. When the amount thereof exceeds 30% by mass, an increased number of polar groups on the toner surface considerably degrade charge stability to the environment, which is not preferred. In addition, the compatibility to the colored particles becomes too high, resulting in that the embedment rates of the protrusions tend to be unfavorably increased. When the amount thereof is adjusted to 20% by mass or less, the average embedment rate of the protrusions is maintained 80% or lower.

Also, a monomer having an ester bond (e.g., 2-acryloyloxyethyl succinate or 2-methacryloyloxyethyl phthalate) may simultaneously be used for controlling compatibility of the toner core particles. In this case, the amount of such a monomer used is 10% by mass or less, preferably 5% by mass or less, more preferably 2% by mass or less, relative to the total amount of the monomers. When the amount thereof is 10% by mass or more, an increased number of polar groups on the toner surface considerably degrade charge stability to the environment, which is not preferred. In addition, the compatibility to the toner core particles becomes too high, resulting in that the embedment rates of the protrusions tend to be unfavorably increased. When the amount thereof is adjusted to 10% by mass or less, the average embedment rate of the protrusions is maintained 80% or lower.

The method for obtaining the vinyl fine resin particles is not particularly limited, and exemplified by the following methods (a) to (f):

(a) a method in which a monomer mixture is allowed to undergone polymerization reaction with a suspension polymerization method, an emulsification polymerization method, a seed polymerization method or a dispersion polymerization method, to thereby produce a dispersion liquid of vinyl fine resin particles;

(b) a method in which a monomer mixture is allowed to undergone polymerization, and the obtained resin is then pulverized using a fine pulverizer of, for example, mechanically rotating type or jetting type, followed by classifying, to thereby produce fine resin particles;

(c) a method in which a monomer mixture is allowed to undergone polymerization, and the obtained resin is then dissolved in a solvent, followed by spraying of the resultant resin solution, to thereby produce fine resin particles;

(d) a method in which a monomer mixture is allowed to undergone polymerization, the obtained resin is dissolved in a solvent, another solvent is added to the resultant resin solution to precipitate fine resin particles, and then the solvent is removed to obtain fine resin particles; or a method in which a monomer mixture is allowed to undergone polymerization, the obtained resin is dissolved in a solvent with heating, the resultant resin solution is cooled to precipitate fine resin particles, and then the solvent is removed to obtain fine resin particles;

(e) a method in which a monomer mixture is allowed to undergone polymerization, the obtained resin is dissolved in a solvent, the resultant resin solution is dispersed in an aqueous medium in the presence of an appropriate dispersing agent, and then the dispersion liquid is, for example, heated or left under reduced pressure; and (f) a method in which a monomer mixture is allowed to undergone polymerization, the obtained resin is dissolved in a solvent, an appropriate emulsifying agent is dissolved in the resultant resin solution, followed by phase-transfer emulsification with the addition of water.

Of these, method (a) is preferably employed, since vinyl fine resin particles can be easily produced as a dispersion liquid, which is easy to use for the next step.

In the polymerization reaction of method (a), preferably, (i) a dispersion stabilizer is added to the aqueous medium, (ii) the monomer mixture to be allowed to undergone polymerization reaction is made to contain a monomer capable of imparting dispersion stability to the fine resin particles obtained through polymerization (i.e., a reactive emulsifier) or the above (i) and (ii) are performed in combination, to thereby impart dispersion stability to the obtained vinyl fine resin particles. When neither the dispersion stabilizer nor the reactive emulsifier is used, the particles cannot be maintained in a dispersion state whereby the vinyl resin cannot be obtained as fine particles, the obtained fine resin particles are poor in dispersion stability whereby they are poor in storage stability resulting in aggregation during storage, or the particles are degraded in dispersion stability at the below-described fine resin particle-attaching step whereby the toner core particles easily aggregate or combined together resulting in that the finally obtained toner is degraded in evenness of particle diameter, shape, surface, etc. which is not preferred.

The dispersion stabilizer is not particularly limited and may be appropriately selected depending on the intended purpose. Examples thereof include surfactants and inorganic dispersing agents. Examples of the surfactant include anionic surfactants such as alkylbenzenesulfonic acid salts, α-olefinsulfonic acid salts and phosphoric acid esters; cationic surfactants such as amines (e.g., alkylamine salts, aminoalcohol fatty acid derivatives, polyamine fatty acid derivatives and imidazoline) and quaternary ammonium salts (e.g., alkyltrimethyl ammonium salts, dialkyldimethyl ammonium salts, alkyldimethylbenzyl ammonium salts, pyridinium salts, alkylisoquinolinium salts and benzethonium chloride); nonionic surfactants such as fatty acid amide derivatives and polyalcohol derivatives; and amphoteric surfactants such as alanine, dodecydi(aminoethyl)glycine, di(octylaminoethyl) glycine and N-alkyl-N,N-dimethylammonium betaine. Examples of the inorganic dispersing agent include tricalcium phosphate, calcium carbonate, titanium oxide, colloidal silica and hydroxyapatite.

The weight average molecular weight of the vinyl resin is not particularly limited and may be appropriately selected depending on the intended purpose. The weight average molecular weight thereof is preferably 3,000 to 300,000, more preferably 4,000 to 100,000, particularly preferably 5,000 to 50,000. When the weight average molecular weight is lower than 3,000, the vinyl resin has low mechanical strength (i.e., is brittle). Thus, the surfaces of the finally obtained toner easily change depending on the working environment of some applications. For example, the toner considerably changes in chargeability and/or causes contamination such as attachment onto the surrounding members, which leads to degradation of image quality. Whereas when the weight average molecular weight is higher than 300,000, the number of ends of the molecules is decreased, so that the molecular chains interact with the toner core particles to a less extent to degrade adhesion to the toner core particles, which is not preferred.

The glass transition temperature (Tg) of the vinyl resin is not particularly limited and may be appropriately selected depending on the intended purpose. It is preferably 45° C. to 100° C., more preferably 55° C. to 90° C., particularly preferably 65° C. to 80° C. When the Tg is lower than 45° C., the finally obtained toner may be degraded in storage stability, for example, may involve blocking during storage at high temperatures. Whereas when the Tg exceeds 100° C., the low-temperature fixing property is degraded. Needless to say, both cases are not preferred.

<Toner Core Particles>

The toner core particles contain, as essential ingredients, at least a first resin and a colorant; and, if necessary, further contain other ingredients such as a releasing agent, a charge controlling agent and a plasticizer.

A toner of the present invention is obtained through the process including a step at which at least the colorant and a binder resin made of the first resin are dissolved or dispersed in an organic solvent, and then the resultant solution or dispersion mixture is dispersed in an aqueous medium to granulate toner core particles; and a step at which fine resin particles of a second resin are embedded in the surface of the toner core particles.

The first resin added to the organic solvent is a resin at least part of which is dissolved in the organic solvent. The resin preferably has an acid value of 2 mgKOH/g to 24 mgKOH/g. When the acid value exceeds 24 mgKOH/g, the resin is likely to transfer to the aqueous phase, resulting in loss of the resin through the production process or easily degrading the dispersion stability of oil droplets. Also, the toner comes to absorb a larger amount of water, leading to degradation of chargeability and storageability under high-temperature, high-humidity environment. Whereas when the acid value is lower than 2 mgKOH/g, the polarity of the resin becomes low, making it difficult to uniformly disperse the colorant with some polarity in the oil droplets.

The type of the first resin is not particularly limited and may be appropriately selected depending on the intended purpose. The first resin is preferably a resin having a polyester skeleton from the viewpoint of obtaining good fixing property. The resin having a polyester skeleton is not particularly limited and may be appropriately selected depending on the intended purpose. Examples thereof include polyester resins and block copolymers of polyesters and resins having other skeletons. Of these, polyester resins are preferably used since the obtained toner particles have high uniformity.

Examples of the polyester resin include ring-opening polymers of lactones, polycondensates of hydroxycarboxylic acid, and polycondensates of polyols and polycarboxylic acids. Of these, polycondensates of polyols and polycarboxylic acids are preferred since a wide variety of polyesters can be formed.

The peak molecular weight of the polyester resin is not particularly limited and may be appropriately selected depending on the intended purpose. It is generally 1,000 to 30,000, preferably 1,500 to 10,000, more preferably 2,000 to 8,000. When the peak molecular weight is lower than 1,000, the heat resistance storage stability of the toner is degraded.

Whereas when the peak molecular weight exceeds 30,000, the low-temperature fixing property of the toner is degraded.

Also, the glass transition temperature of the polyester resin is not particularly limited and may be appropriately selected depending on the intended purpose. It is preferably 45° C. to 70° C., more preferably 50° C. to 65° C. Presumably, the toner or toner cartridge is transported under high-temperature, high-humidity environment of 40° C. and 90%. Thus, when the glass transition temperature is lower than 45° C., the obtained toner particles are deformed under application of a certain pressure or stick to each other. As a result, there is a possibility that the toner particles cannot behave as particles. When the glass transition temperature is higher than 70° C., the formed toner is degraded in low-temperature fixing property. Needless to say, both cases are not preferred.

<Polyol>

Examples of polyols (1) include diols (1-1) and trihydric or higher polyols (1-2), with (1-1) alone or a mixture containing (1-1) and a small amount of (1-2) being preferred.

Examples of diols (1-1) include alkylene glycols (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexanedimethanol and hydrogenated bisphenol A); bisphenols (e.g., bisphenol A, bisphenol F and bisphenol S); adducts of the above-listed alicyclic diols with alkylene oxides (e.g., ethylene oxide, propylene oxide and butylene oxide); 4,4'-dihydroxybiphenyls such as 3,3'-difluoro-4,4'-dihydroxybiphenyl; bis(hydroxyphenyl)alkanes such as bis(3-fluoro-4-hydroxyphenyl)methane, 1-phenyl-1,1-bis(3-fluoro-4-hydroxyphenyl)ethane, 2,2-bis(3-fluoro-4-hydroxyphenyl) propane, 2,2-bis(3,5-difluoro-4-hydroxyphenyl)propane (also known as tetrafluorobisphenol A) and 2,2-bis(3-hydroxyphenyl)-1,1,1,3,3,3-hexafluoropropane; bis(4-hydroxyphenyl)ethers such as bis(3-fluoro-4-hydroxyphenyl)ether; and adducts of the above-listed bisphenols with alkylene oxides (e.g., ethylene oxide, propylene oxide and butylene oxide).

Of these, preferred are C2 to C12 alkylene glycols and alkylene oxide adducts of bisphenols. More preferred are combinations of alkylene oxide adducts of bisphenols and C2 to C12 alkylene glycols.

Examples of the trihydric or higher polyols (1-2) include trihydric to octahydric or higher aliphatic polyalcohols (e.g., glycerin, trimethylolethane, trimethylolpropane, pentaerythritol and sorbitol); trihydric or higher phenols (e.g., trisphenol PA, phenol novolac and cresol novolac); and alkylene oxide adducts of the above trihydric or higher polyphenols.

<Polycarboxylic Acid>

Examples of polycarboxylic acids (2) include dicarboxylic acids (2-1) and trivalent or higher polycarboxylic acids (2-2), with (2-1) alone or a mixture containing (2-1) and a small amount of (2-2) being preferred.

Examples of dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl) hexafluoropropane, 2,2-bis(3-carboxyphenyl) hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid and hexafluoroisopropylidenediphthalic anhydride. Of these, preferred are C4 to C20 alkenylenedicarboxylic acids and C8 to C20 aromatic dicarboxylic acids.

Examples of trivalent or higher polycarboxylic acids (2-2) include C9 to C20 aromatic polycarboxylic acids (e.g., trimellitic acid and pyromellitic acid). Notably, polycarboxylic acids (2) reacted with polyols (1) may be acid anhydrides or lower alkyl esters (e.g., methyl ester, ethyl ester and isopropyl ester) of the above carboxylic acids.

The ratio between polyol and polycarboxylic acid is not particularly limited and may be appropriately selected depending on the intended purpose. The ratio therebetween is generally 2/1 to 1/2, preferably 1.5/1 to 1/1.5, more preferably 1.3/1 to 1/1.3, in terms of the equivalent ratio [OH]/[COOH] of the hydroxyl group [OH] to the carboxyl group [COOH].

<Modified Resin>

In order for the toner to have an increased mechanical strength and involve no hot offset upon fixing, a modified resin containing an end isocyanate group may be dissolved in the oil phase for producing the toner. The method for producing the isocyanate group-containing modified resin is not particularly limited and may be appropriately selected depending on the intended purpose. Examples thereof include a method in which an isocyanate group-containing monomer is used for polymerization reaction to obtain an isocyanate group-containing resin; and a method in which a resin having an active hydrogen-containing group at its end is obtained through polymerization and then reacted with polyisocyanate to obtain a polymer containing an isocyanate group at its end. The latter method is preferred from the viewpoint of satisfactorily introducing an isocyanate group into the end of the polymer. Examples of the active hydrogen-containing group include a hydroxyl group (i.e., an alcoholic hydroxyl group and a phenolic hydroxyl group), an amino group, a carboxyl group and a mercapto group, with an alcoholic hydroxyl group being preferred. Considering uniformity of particles, the skeleton of the isocyanate group-containing modified resin is preferably the same as that of a resin dissolvable in the organic solvent. The resin preferably has a polyester skeleton. In one employable method for producing a polyester having an alcoholic hydroxyl group at its end, polycondensation reaction is performed between a polyol having more functional groups (i.e., hydroxyl groups) and a polycarboxylic acid having less functional groups (i.e., carboxyl groups).

<Amine Compound>

In the process of dispersing the oil phase in the aqueous phase to form particles, some isocyanate groups of the modified resin are hydrolyzed into amino groups, which are then reacted with unreacted isocyanate groups to allow elongation reaction to proceed. Also, an amine compound may be used in combination to perform elongation reaction and introduce crosslinked points as well as the above reaction. The amine compound (B) is not particularly limited and may be appropriately selected depending on the intended purpose. Examples thereof include diamines (B1), trivalent or higher polyamines (B2), aminoalcohols (B3), aminomercaptans (B4), amino acids (B5) and amino-blocked compounds (Be) obtained by blocking the amino group of B1 to B5.

The diamine (B1) is not particularly limited and may be appropriately selected depending on the intended purpose. Examples thereof include aromatic diamines (e.g., phenylene diamine, diethyltoluene diamine, 4,4'-diaminodiphenylmethane, tetrafluoro-p-xylylenediamine and tetrafluoro-p-phenylenediamine); alicyclic diamines (e.g., 4,4'-diamino-3, 3'-dimethyldicyclohexylmethane, diaminecyclohexane and isophorondiamine); and aliphatic diamines (e.g., ethylenediamine, tetramethylenediamine, hexamethylenediamine, dodecafluorohexylenediamine and tetracosafluorododecylenediamine). The trivalent or higher polyamine (B2) is not particularly limited and may be appropriately selected depending on the intended purpose. Examples thereof include diethylenetriamine and triethylenetetramine.

The aminoalcohol (B3) is not particularly limited and may be appropriately selected depending on the intended purpose. Examples thereof include ethanolamine and hydroxyethylaniline. The aminomercaptan (B4) is not particularly limited and may be appropriately selected depending on the intended purpose. Examples thereof include aminoethylmercaptan and aminopropylmercaptan. The amino acid (B5) is not particularly limited and may be appropriately selected depending on the intended purpose. Examples thereof include aminopropionic acid and aminocaproic acid.

The amino-blocked compound (B6) obtained by blocking the amino group of B1 to B5 is not particularly limited and may be appropriately selected depending on the intended purpose. Examples thereof include oxazolidine compounds and ketimine compounds derived from the amines B1 to B5 and ketones (e.g., acetone, methyl ethyl ketone and methyl isobutyl ketone). Among these amines (B), preferred are B1 and a mixture containing B1 and a small amount of B2.

Regarding the amount of the amine (B) relative to the amount of the isocyanate group-containing prepolymer (A), the number of amino groups [NHx] in the amine (B) is preferably four or less times, more preferably twice or less, particularly preferably 1.5 or less times, most preferably 1.2 or less times, the number of isocyanate groups [NCO] in the isocyanate group-containing prepolymer (A). When the number of amino groups [NHx] in the amine (B) is preferably more than four times the number of isocyanate groups [NCO] in the isocyanate group-containing prepolymer (A), excessive amino groups disadvantageously block isocyanate groups to prevent the elongation reaction of the modified resin. As a result, the polyester is decreased in molecular weight, resulting in degradation of hot offset resistance of the toner.

<Organic Solvent>

The organic solvent is preferably a volatile organic solvent having a boiling point lower than 100° C. from the viewpoint of easily removing the solvent. The organic solvent is not particularly limited and may be appropriately selected depending on the intended purpose. Examples thereof include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone and methyl isobutyl ketone. These may be used alone or in combination. When the resin to be dissolved or dispersed in the organic solvent has a polyester skeleton, preferably used are ester solvents (e.g., methyl acetate, ethyl acetate and butyl acetate) or ketone solvents (e.g., methyl ethyl ketone and methyl isobutyl ketone) since these solvents have high dissolution capability to the resin. Among them, methyl acetate, ethyl acetate and methyl ethyl ketone are particularly preferred since these can be removed more easily.

<Aqueous Medium>

The aqueous medium may be water alone or a mixture of water and a water-miscible solvent. The water-miscible solvent is not particularly limited and may be appropriately selected depending on the intended purpose. Examples thereof include alcohols (e.g., methanol, isopropanol and ethylene glycol), dimethylformamide, tetrahydrofuran, cellosolves (e.g., methyl cellosolve) and lower ketones (e.g., acetone and methyl ethyl ketone).

<Surfactant>

A surfactant is used for dispersing the oil phase in the aqueous medium to form liquid droplets. The amount of the surfactant contained in the aqueous medium is preferably 7% or less, more preferably 5% or less, particularly preferably 3% or less, since the surfactant greatly influences the embedment rates of the fine resin particles. When the amount thereof is more than 7%, the wettability of the toner becomes too high to make it difficult to form protrusions, which is not preferred. By adjusting the surfactant to 7% or less, it becomes possible for the embedment rates of the fine resin particles to be 40% or higher.

The surfactant is not particularly limited and may be appropriately selected depending on the intended purpose. Examples thereof include anionic surfactants such as alkylbenzenesulfonic acid salts, α-olefin sulfonic acid salts and phosphoric acid esters; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyl dimethylammonium salts, alkyl dimethyl benzyl ammonium salts, pyridinium salts, alkyl isoquinolinium salts and benzethonium chloride); nonionic surfactants such as fatty acid amide derivatives and polyhydric alcohol derivatives; and amphoteric surfactants such as alanine, dodecyldi(aminoethyl)glycine, di(octylaminoethyl)glycine and N-alkyl-N,N-dimethylammonium betaine. Also, a fluoroalkyl group-containing surfactant can exhibit its dispersing effects even in a very small amount.

The fluoroalkyl group-containing surfactant is not particularly limited and may be appropriately selected depending on the intended purpose. Examples thereof include fluoroalkyl group-containing anionic surfactants and fluoroalkyl group-containing cationic surfactants.

The fluoroalkyl group-containing anionic surfactant is not particularly limited and may be appropriately selected depending on the intended purpose. Examples thereof include fluoroalkyl carboxylic acids having 2 to 10 carbon atoms and metal salts thereof, disodium perfluorooctanesulfonylglutamate, sodium 3-[ω-fluoroalkyl(C6 to C11)oxy)-1-alkyl(C3 or C4) sulfonates, sodium 3-[ω-fluoroalkanoyl (C6 to C8)-N-ethylamino]-1-propanesulfonates, fluoroalkyl (C11 to C20) carboxylic acids and metal salts thereof, perfluoroalkylcarboxylic acids(C7 to C13) and metal salts thereof, perfluoroalkyl(C4 to C12)sulfonates and metal salts thereof, perfluorooctanesulfonic acid diethanol amide, N-propyl-N-(2-hydroxyethyl)perfluorooctanesulfone amide, perfluoroalkyl(C6 to C10)sulfonamide propyltrimethylammonium salts, salts of perfluoroalkyl(C6 to C10)-N-ethylsulfonylglycin and monoperfluoroalkyl(C6 to C16) ethylphosphates. The fluoroalkyl group-containing cationic surfactant is not particularly limited and may be appropriately selected depending on the intended purpose. Examples thereof include aliphatic primary, secondary or tertiary amine containing a fluoroalkyl group, aliphatic quaternary ammonium salts (e.g., perfluoroalkyl(C6 to C10)sulfonamide propyltrimethylammonium salts, benzalkonium salts, benzethonium chloride, pyridinium salts and imidazolinium salts.

<Inorganic Dispersing Agent>

The dissolution or dispersion product of the toner composition may be dispersed in the aqueous medium in the presence of an inorganic dispersing agent or fine resin particles. The inorganic dispersing agent is not particularly limited and may be appropriately selected depending on the intended purpose. Examples thereof include tricalcium phosphate, calcium carbonate, titanium oxide, colloidal silica and hydroxyapatite. Use of the dispersing agent is preferred since a sharp particle size distribution and a stable dispersion state can be attained.

<Protective Colloid>

Further, a polymeric protective colloid may be used to stabilize dispersed liquid droplets.

The polymeric protective colloid is not particularly limited and may be appropriately selected depending on the intended purpose. Examples thereof include acids (e.g., acrylic acid, methacrylic acid, α-cyanoacrylic acid, α-cyanomethacrylic acid, itaconic acid, crotonic acid, fumaric acid, maleic acid and maleic anhydride); hydroxyl group-containing (meth) acrylic monomers (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid esters, diethylene glycol monomethacrylic acid esters, glycerin monoacrylic acid esters, glycerin monomethacrylic acid esters, N-methylolacrylamide and N-methylolmethacrylamide), vinyl alcohol and ethers thereof (e.g., vinyl methyl ether, vinyl ethyl ether and vinyl propyl ether), esters formed between vinyl alcohol and a carboxyl group-containing compound (e.g., vinyl acetate, vinyl propionate and vinyl butyrate); acrylamide, methacrylamide, diacetone acrylamide and methylol compounds thereof; acid chlorides (e.g., acrylic acid chloride and methacrylic acid chloride); homopolymers or copolymers of nitrogen-containing compounds and nitrogen-containing heterocyclic compounds (e.g., vinyl pyridine, vinyl pyrrolidone, vinyl imidazole and ethyleneimine); polyoxyethylenes (e.g., polyoxyethylene, polyoxypropylene, polyoxyethylene alkyl amines, polyoxypropylene alkyl amines, polyoxyethylene alkyl amides, polyoxypropylene alkyl amides, polyoxyethylene nonylphenyl ethers, polyoxyethylene laurylphenyl ethers, polyoxyethylene stearylphenyl esters and polyoxyethylene nonylphenyl esters); and celluloses (e.g., methyl cellulose, hydroxyethyl cellulose and hydroxypropyl cellulose).

When an acid- or alkali-soluble compound (e.g., calcium phosphate) is used as a dispersion stabilizer, the calcium phosphate used is dissolved with an acid (e.g., hydrochloric acid), followed by washing with water, to thereby remove it from the formed fine particles (toner particles). Also, the calcium phosphate may be removed through enzymatic decomposition. Alternatively, the dispersing agent used may remain on the surfaces of the toner particles. But, the dispersing agent is preferably removed through washing after elongation and/or crosslinking reaction in terms of chargeability of the formed toner.

<Colorant>

The colorant usable in the present invention is not particularly limited and may be appropriately selected depending on the intended purpose from known dyes and pigments. Examples thereof include carbon black, nigrosine dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmin 6B, pigment scarlet 3B, bordeaux 5B, toluidine Maroon, permanent bordeaux F2K, Helio bordeaux BL, bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanin blue, phthalocyanin blue, fast sky blue, indanthrene blue (RS and BC), indigo, ultramarine, iron blue, anthraquinon blue, fast violet B, methylviolet lake, cobalt purple, manganese violet, dioxane violet, anthraquinon violet, chrome green, zinc green, chromium oxide, viridian, emerald green, pigment green B, naphthol green B, green gold, acid green lake, malachite green lake, phthalocyanine green, anthraquinon green, titanium oxide, zinc flower, lithopone and mixtures thereof.

[Colorant Formed into Masterbatch]

In the present invention, the colorant may be mixed with a resin to form a masterbatch.

Examples of the binder resin which is used for producing a masterbatch or which is kneaded together with a masterbatch include the above-described modified or unmodified polyester resins; styrene polymers and substituted products thereof (e.g., polystyrenes, poly-p-chlorostyrenes and polyvinyltoluenes); styrene copolymers (e.g., styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloro methacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers); polymethyl methacrylates; polybutyl methacrylates; polyvinyl chlorides; polyvinyl acetates; polyethylenes; polypropylenes, polyesters; epoxy resins; epoxy polyol resins; polyurethanes; polyamides; polyvinyl butyrals; polyacrylic acid resins; rosin; modified rosin; terpene resins; aliphatic or alicyclic hydrocarbon resins; aromatic petroleum resins; chlorinated paraffins; and paraffin waxes. These may be used alone or in combination.

[Preparation Method of Masterbatch]

The masterbatch can be prepared by mixing/kneading a colorant with a resin for use in a masterbatch through application of high shearing force. Also, an organic solvent may be used for improving mixing between these materials. Further, the flashing method, in which an aqueous paste containing a colorant is mixed/kneaded with a resin and an organic solvent and then the colorant is transferred to the resin to remove water and the organic solvent, is preferably used, since a wet cake of the colorant can be directly used (i.e., no drying is required to be performed). In this mixing/kneading, a high-shearing disperser (e.g., three-roll mill) is preferably used.

<<Releasing Agent>>

In order for the toner to have an increased releasing property during fixing, a releasing agent may be dispersed in the organic solvent in advance.

The releasing agent may be wax, silicone oil, etc. that exhibit a sufficiently low viscosity when heated during the fixing process and that are difficult to be compatible or swelled with other toner materials on the fixing member surface. Considering the storage stability of the toner, preferably used is wax that generally exists as a solid in the toner during storage.

The wax is not particularly limited and may be appropriately selected depending on the intended purpose. Examples thereof include long-chain hydrocarbons and carbonyl group-containing waxes.

Examples of the long-chain hydrocarbon include polyolefin waxes (e.g., polyethylene wax and polypropylene wax); petroleum waxes (e.g., paraffin waxes, SASOL wax and microcrystalline waxes); and Fischer-Tropsch waxes.

Examples of the carbonyl group-containing wax include polyalkanoic acid esters (e.g., carnauba wax, montan wax, trimethylolpropane tribehenate, pentaerythritol tetrabehenate, pentaerythritol diacetatedibehenate, glycerine tribehenate and 1,18-octadecanediol distearate); polyalkanol esters (e.g., tristearyl trimellitate and distearyl malleate); polyalkanoic acid amides (e.g., ethylenediamine dibehenylamide); polyalkylamides (e.g., trimellitic acid tristearylamide); and dialkyl ketones (e.g., distearyl ketone).

Of these, long-chain hydrocarbons are preferred since they exhibit better releasing property. Furthermore, the long-chain hydrocarbons may be used in combination with the carbonyl group-containing waxes. The amount of the releasing agent contained in the toner is not particularly limited and may be appropriately selected depending on the intended purpose. It is preferably 2% by mass to 25% by mass, more preferably 3% by mass to 20% by mass, particularly preferably 4% by mass to 15% by mass. When it is less than 2% by mass, the releasing property of the formed toner cannot be obtained during fixing. Whereas when it is more than 25% by mass, the formed toner is degraded in mechanical strength.

<<Charge Controlling Agent>>

If necessary, a charge controlling agent may be dissolved or dispersed in the organic solvent in advance.

The charge controlling agent is not particularly limited and may be any known charge controlling agent. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (these products are of ORIENT CHEMICAL INDUSTRIES CO., LTD), quaternary ammonium salt molybdenum complex TP-302 and TP-415 (these products are of Hodogaya Chemical Co., Ltd.), quaternary ammonium salt COPY CHARGE PSY VP 2038, triphenylmethane derivative COPY BLUE PR, quaternary ammonium salt COPY CHARGE NEG VP2036 and COPY CHARGE NX VP434 (these products are of Hoechst AG), LRA-901 and boron complex LR-147 (these products are of Japan Carlit Co., Ltd.), copper phthalocyanine, perylene, quinacridone, azo pigments, and polymeric compounds having, as a functional group, a sulfonic acid group, carboxyl group, quaternary ammonium salt, etc. The amount of the charge controlling agent contained in the toner is not particularly limited and may be determined depending on the intended purpose, so long as the charge controlling agent can exhibit its performances without degrading the fixing property of the toner. The amount thereof is preferably 0.5% by mass to 5% by mass, more preferably 0.8% by mass to 3% by mass.

[Production Method of Toner Core Particles]

The production method of the toner core particles is not particularly limited and may be a known toner particle production method selected depending on the intended purpose. In particular, there can be employed an emulsification aggregation method, a dissolution suspension method and a suspension polymerization method, each of which uses an aqueous medium.

After the toner core particles have been produced by a known emulsification aggregation method or suspension polymerization method, fine resin particles are added to the reaction system, so that the fine resin particles are attached to and fused with the surfaces of the toner core particles. Here, the reaction system may be heated to promote attachment and fusion of the fine resin particles. Also, use of a metal salt is effective in promoting the attachment and fusion.

(Preparation Step of Oil Phase)

The oil phase, which contains an organic solvent and a resin, a colorant, etc. dissolved or dispersed in the organic solvent, may be prepared in the following manner. Specifically, the resin, the colorant, etc. are gradually added to the organic solvent under stirring so that these materials are dissolved or dispersed therein. Notably, when a pigment is used as the colorant and/or when the releasing agent, the charge controlling agent, etc. used are poorly dissolvable to the organic solvent, the particles of these materials are preferably micronized before the addition to the organic solvent.

As described above, the colorant may be formed into a masterbatch. Similarly, the releasing agent, the charge controlling agent, etc. may be formed into a masterbatch.

In another means, the colorant, the releasing agent and the charge controlling agent may be dispersed through a wet process in the organic solvent, if necessary in the presence of a dispersion aid, to thereby obtain a wet master.

In still another means, when dispersing the materials melted at a temperature lower than the boiling point of the organic solvent, they are heated under stirring in the organic solvent, if necessary in the presence of a dispersion aid to be stirred together with the dispersoids; and the resultant solution is cooled with stirring or shearing so that the dissolved materials are crystallized, to thereby produce microcrystals of the dispersoids.

After the colorant, releasing agent and charge controlling agent, dispersed with any of the above means, have been dissolved or dispersed in the organic solvent together with a resin, the resultant mixture may be further dispersed. The dispersion may be performed using a known disperser such as a bead mill or a disc mill.

(Preparation Step of Toner Core Particles)

No particular limitation is imposed on the method for preparing a dispersion liquid containing toner core particles formed of the oil phase by dispersing the oil phase obtained at the above-described step in the aqueous medium containing at least the surfactant. This method may use a known disperser such as a low-speed shearing disperser, a high-speed shearing disperser, a friction disperser, a high-pressure jet disperser or an ultrasonic disperser. Among them, a high-speed shearing disperser is preferably used to form dispersoids having a particle diameter of 2 μm to 20 μm. The rotation speed of the high-speed shearing disperser is not particularly limited but is generally 1,000 rpm to 30,000 rpm, preferably 5,000 rpm to 20,000 rpm. The dispersion time is not particularly limited but is generally 0.1 min to 5 min in a batch method. When the dispersion time exceeds 5 min, unfavorable small particles remain and excessive dispersion is performed to make the dispersion system unstable, potentially forming aggregates and coarse particles, which is not preferred. The dispersion temperature is not particularly limited and may be appropriately selected depending on the intended purpose. It is generally 0° C. to 40° C., preferably 10° C. to 30° C. When the dispersion temperature exceeds 40° C., molecular movements are excited to degrade dispersion stability, easily forming aggregates and coarse particles, which is not preferred. Whereas when the dispersion temperature is lower than 0° C., the dispersion liquid is increased in viscosity to require elevated energy for dispersion, leading to a drop in production efficiency. The surfactant usable may be the same as those mentioned in the above-described production method of the fine resin particles. In order to efficiently disperse the oil droplets containing the solvent, the surfactant used is preferably a disulfonic acid salt having a relatively high HLB. The amount of the surfactant contained in the aqueous medium is not particularly limited and may be appropriately selected depending on the intended purpose. The amount thereof is preferably 1% by mass to 10% by mass, more preferably 2% by mass to 8% by mass, particularly preferably 3% by mass to 7% by mass. When the amount thereof exceeds 10% by mass, each oil droplet becomes too small and also has a reverse micellar structure. Thus, the dispersion stability is degraded due to the surfactant added in such an amount, to thereby easily form coarse oil droplets. Whereas when the amount thereof is lower than 1% by mass, the oil droplets cannot be stably dispersed to form coarse oil droplets. Needless to say, both cases are not preferred.

(Fine Resin Particle-Attaching Step)

The dissolution suspension method may be performed as described above. However, the following method is preferably employed since the fine resin particles are attached onto or fused with the toner core particles more firmly. Specifically, the method includes dissolving or dispersing materials of the toner core particles in an organic solvent to prepare an oil phase, dispersing the oil phase in an aqueous medium, and adding fine resin particles so as to be attached onto and fused with the surfaces of liquid droplets of the oil phase. Addition of the fine resin particles at the production step of toner core particles forms large, ununiform protrusions, which is not preferred.

Next, description will be given to the fine resin particle-attaching step, taking as an example the case where vinyl fine resin particles are used as the fine resin particles.

The obtained toner core particle dispersion liquid contains stable liquid droplets of the core particles, so long as the dispersion liquid is being stirred. For attaching the fine resin particles onto the toner core particles, the fine resin particle dispersion liquid is added to this core particle slurry where the liquid droplets of the oil phase are dispersed in the aqueous phase. The vinyl fine resin particle dispersion liquid is added thereto for 30 sec or longer. When it is added for 30 sec or shorter, the dispersion system drastically changes to form aggregated particles. In addition, the vinyl fine resin particles are ununiformly attached onto the toner core particles, which is not preferred. Meanwhile, adding the vinyl fine resin particle dispersion liquid over an unnecessarily long period of time (e.g., 60 min or longer) is not preferred from the viewpoint of lowering production efficiency.

Before added to the toner core particle dispersion liquid, the vinyl fine resin particle dispersion liquid may be appropriately diluted or concentrated so as to have a desired concentration. The amount of the vinyl fine resin particles contained in the vinyl fine resin particle dispersion liquid is not particularly limited and may be appropriately selected depending on the intended purpose. It is preferably 5% by mass to 30% by mass, more preferably 8% by mass to 20% by mass. When the amount thereof is less than 5% by mass, the concentration of the organic solvent greatly changes upon addition of the dispersion liquid to lead to insufficient attachment of the fine resin particles, which is not preferred. Also, when the amount thereof exceeds 30% by mass, the fine resin particles tend to be localized in the toner core particle dispersion liquid, resulting in that the fine resin particles are ununiformly attached onto the toner core particles, which is not preferred.

Also, for the production of liquid droplets of the oil phase, the amount of the surfactant contained in the aqueous phase is not particularly limited and may be appropriately selected depending on the intended purpose. It is preferably 7% by mass or less, more preferably 6% by mass or less, particularly preferably 5% by mass or less. When the amount of the surfactant exceeds 7% by mass, the embedment rates of the fine resin particles considerably decrease, which is not preferred.

The following may explain the reason why the vinyl fine resin particles are sufficiently firmly attached onto the toner core particles by the method of the present invention. Specifically, when the vinyl fine resin particles are attached onto the liquid droplets of the toner core particles, the toner core particles can freely deform to sufficiently form contact surfaces with the vinyl fine resin particles and the vinyl fine resin particles are swelled with or dissolved in the organic solvent to make it easier for the vinyl fine resin particles to adhere to the resin in the toner core particles. Therefore, in this state, the organic solvent must exist in the system in a sufficiently large amount. Specifically, the amount of the organic solvent contained is not particularly limited and may be appropriately selected depending on the intended purpose. In the toner core particle dispersion liquid, the amount of the organic solvent is preferably 50% by mass to 150% by mass, more preferably 70% by mass to 125% by mass, relative to the amount of the solid matter (e.g., resin, colorant, if necessary, releasing agent and charge controlling agent). When the amount of the organic solvent exceeds 150% by mass, the amount of the toner obtained through one production process is reduced, resulting in low production efficiency. Also, a large amount of the organic solvent impairs dispersion stability, making it difficult to attain stable production, which is not preferred.

The temperature at which the vinyl fine resin particles are attached onto the toner core particles is preferably 10° C. to 60° C., more preferably 20° C. to 45° C. When the temperature exceeds 60° C., energy required for production increases to give greater load to the environment during production. In addition, vinyl fine resin particles with a low acid value are present on the surfaces of the liquid droplets and thus, dispersion becomes unstable to form coarse particles in some cases. Whereas when the temperature is lower than 10° C., the dispersion liquid increases in viscosity, resulting in that the fine resin particles are not attached onto the toner core particles satisfactorily. Needless to say, both cases are not preferred.

The amount of the fine resin particles relative to the total mass of the toner is not particularly limited and may be appropriately selected depending on the intended purpose. It is preferably 1% by mass to 20% by mass, more preferably 3% by mass to 15% by mass, particularly preferably 5% by mass to 10% by mass. When the amount thereof is 1% by mass or less, satisfactory effects cannot be obtained. Whereas when the amount thereof is 20% by mass or more, excessive fine resin particles are weakly attached onto the toner core particles, causing filming or other unfavorable phenomena.

Besides, the toner core particles and the fine resin particles may be mixed and stirred together so as to attain mechanical adhesion or coating of the fine resin particles on the toner core particles.

<Desolvation Step>

In one employable means for removing the organic solvent from the obtained toner base particle dispersion liquid, the entire system is gradually increased in temperature with stirring, to thereby completely evaporate off the organic solvent contained in the liquid droplets.

In another employable means, the obtained toner base particle dispersion liquid with stirring is sprayed toward a dry atmosphere, to thereby completely evaporate off the organic solvent contained in the liquid droplets. In still another employable means, the toner base particle dispersion liquid is reduced in pressure with stirring to evaporate off the organic solvent. The latter two means may be used in combination with the first means.

The dry atmosphere toward which the emulsified dispersion liquid is sprayed generally uses heated gas (e.g., air, nitrogen, carbon dioxide and combustion gas), especially, gas flow heated to a temperature equal to or higher than the highest boiling point of the solvents used. By removing the organic solvent even in a short time using, for example, a spray dryer, a belt dryer or a rotary kiln, the resultant product has satisfactory quality.

<Aging Step>

When a modified resin having an end isocyanate group is added, an aging step may be performed to allow elongation/crosslinking reaction of the isocyanate to proceed. The aging time is generally 10 min to 40 hours, preferably 2 hours to 24 hours. The aging temperature is generally 0° C. to 65° C., preferably 35° C. to 50° C.

<Washing Step>

The dispersion liquid of the toner base particles obtained in the above-described manner contains not only the toner base particles but also subsidiary materials (e.g., dispersing agents such as the surfactant). Thus, the dispersion liquid is washed to separate the toner base particles from the subsidiary materials. Examples of the washing method of the toner base particles include a centrifugation method, a reduced-pressure filtration method and a filter press method, but employable washing methods in the present invention are not limited thereto. Any of the above methods forms a cake of the toner base particles. If the toner base particles are not sufficiently washed through only one washing process, the formed cake may be dispersed again in an aqueous solvent to form a slurry, which is repeatedly treated with any of the above methods to taken out the toner base particles. When a reduced-pressure filtration method or a filter press method is employed for washing, an aqueous solvent may be made to penetrate the cake to wash out the subsidiary materials contained in the toner base particles. The aqueous solvent used for washing is water or a solvent mixture of water and an alcohol such as methanol or ethanol. Use of water is preferred from the viewpoint of reducing cost and environmental load caused by, for example, drainage treatment.

<Drying Step>

The washed toner base particles containing the aqueous medium in a large amount are dried to remove the aqueous medium, whereby only toner base particles can be obtained. The drying method uses, for example, a spray dryer, a vacuum freezing dryer, a reduced-pressure dryer, a ventilation shelf dryer, a movable shelf dryer, a fluidized-bed-type dryer, a rotary dryer or a stirring-type dryer. The toner base particles are preferably dried until the water content is finally decreased less than 1% by mass. Also, when the dry toner base particles flocculate to cause inconvenience in use, the flocculated particles may be separated from each other through beating using, for example, a jet mill, HENSCHEL MIXER, a super mixer, a coffee mill, an oster blender or a food processor.

(Image Forming Method and Image Forming Apparatus)

An image forming method of the present invention includes a charging step, an exposing step, a developing step, a transfer step and a fixing step; and, if necessary, further includes appropriately selected other steps such as a charge-eliminating step, a recycling step and a controlling step.

A toner used in the above developing step must be the toner of the present invention.

An image forming apparatus of the present invention includes a latent image bearing member (hereinafter also referred to a "photoconductor"), a charging unit, an exposing unit, a toner, a developing unit, a transfer unit and a fixing unit; and, if necessary, further includes appropriately selected other units such as a charge-eliminating unit, a recycling unit and a controlling unit.

The toner in the image forming apparatus of the present invention must be the toner of the present invention. Notably, the toner of the present invention may be used as a one-component developer or a two-component developer. Preferably, the toner of the present invention is used as a one-component developer. Also, the image forming apparatus of the present invention preferably has an endless intermediate transfer unit. Further, the image forming apparatus of the present invention preferably has a cleaning unit configured to remove the toner remaining on the photoconductor and/or the intermediate transfer unit. The cleaning unit does not necessarily have to have a cleaning blade. The image forming apparatus of the present invention preferably has a fixing unit configured to fix an image with a roller or belt having a heating device. The fixing unit in the image forming apparatus of the present invention is a fixing unit having a fixing member that requires no oil application.

The image forming apparatus of the present invention may be formed into a process cartridge, which is detachably mounted to the main body of the image forming apparatus, by incorporating together the photoconductor and the constituent members (e.g., the developing unit and the cleaning unit). Alternatively, the photoconductor and at least one of the charging unit, exposing unit, developing unit, transfer unit, separating unit and cleaning unit are supported together to form a process cartridge, which is a single unit detachably mounted to the main body of the image forming apparatus using a guide unit thereof (e.g., a rail).

Figure 2:
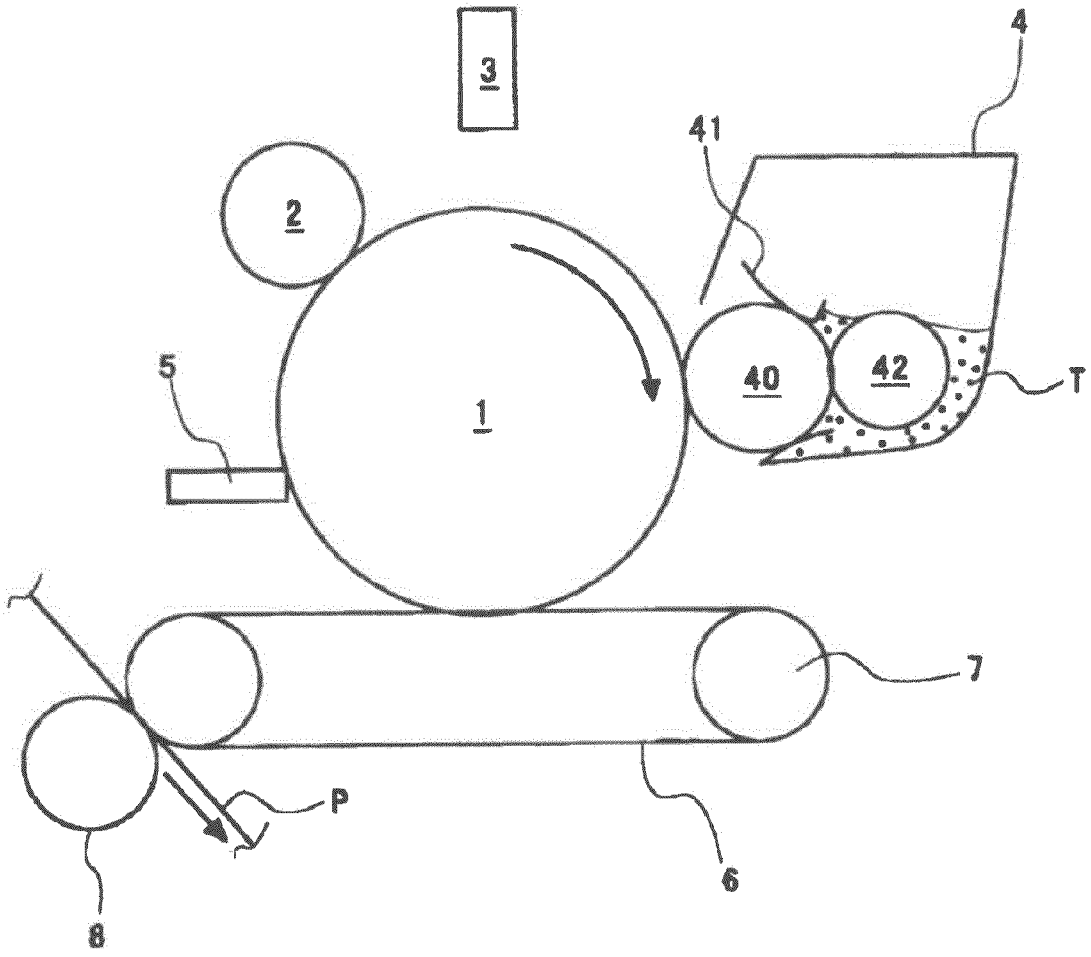
FIG. 2 is an explanatory view of essential parts of one exemplary image forming apparatus in which an electrostatic image developing toner of the present invention is used.

FIG. 2 illustrates one exemplary image forming apparatus of the present invention. This image forming apparatus contains, in an unillustrated main body casing, a latent image bearing member (1) rotated clockwise in FIG. 2 which is provided therearound with a cleaning device (2), an exposing device (3), a developing unit (4) having the electrostatic image developing toner (T) of the present invention, a cleaning part (5), an intermediate transfer medium (6), a supporting roller (7), a transfer roller (8), an unillustrated charge-eliminating unit, etc.

This image forming apparatus has an unillustrated paper-feeding cassette containing a plurality of recording paper sheets (P), which are exemplary recording media. The recording paper sheets (P) in the paper-feeding cassette are fed one by one with an unillustrated paper-feeding roller to between the intermediate transfer medium (6) and the transfer roller (8) serving as a transfer unit. Before fed to therebetween, the recording paper sheet is retained with a pair of registration rollers so that it can be fed at a desired timing.

In this image forming apparatus, while being rotated clockwise in FIG. 2, the latent image bearing member (1) is uniformly charged with the charging device (2). Then, the latent image bearing member (1) is irradiated with laser beams modulated by image date from the exposing device (3), to thereby form a latent electrostatic image. The latent electrostatic image formed on the latent image bearing member (1) is developed with the toner using the developing unit (4). Next, the toner image formed with the developing unit (4) is transferred from the latent image bearing member (1) to the intermediate transfer medium (6) through application of transfer bias. Separately, the recording paper sheet (P) is fed to between the intermediate transfer medium (6) and the transfer roller (8), whereby the toner image is transferred onto the recording paper sheet (P). Moreover, the recording paper sheet (P) with the toner image is conveyed to an unillustrated fixing unit.

The fixing unit has a fixing roller and a press roller, wherein the fixing roller is heated to a predetermined temperature and the press roller is pressed against the fixing roller at a predetermined pressure. The fixing unit heats and presses the recording paper sheet conveyed from the transfer roller (8), to thereby fix the toner image on the recording paper sheet, which is then discharged to an unillustrated discharge tray.

In the image forming apparatus after the above-described recording process, the latent image bearing member (1), from which the toner image has been transferred by the transfer roller (8) onto the recording paper sheet, is further rotated to reach the cleaning part (5), where the toner remaining on the surface of the latent image bearing member (1) is scraped off. Then, the latent image bearing member (1) is charge-eliminated with an unillustrated charge-eliminating device. The image forming apparatus uniformly charges, with the charging device (2), the latent image bearing member (1) which has been charge-eliminated by the charge-eliminating device, and performs the next image formation in the same manner as described above.

Next will be described in detail the members suitably used in the image forming apparatus of the present invention.

The material, shape, structure, size, etc. of the latent image bearing member (1) are not particularly limited and may be appropriately selected from those know in the art. The latent image bearing member is suitably in the form of a drum or belt, and is, for example, an inorganic photoconductor made of amorphous silicon, selenium or the like and an organic photoconductor made of polysilane, phthalopolymethine or the like. Of these, an amorphous silicon photoconductor or an organic photoconductor is preferred since it has a long service life.

The latent electrostatic image can be formed on the latent image bearing member (1) with a latent electrostatic image-forming unit by, for example, imagewise exposing the charged surface of the latent image bearing member (1). The latent electrostatic image-forming unit contains at least the charging device (2) which charges the surface of the latent image bearing member (1) and the exposing device (3) which imagewise exposes the surface of the latent image bearing member (1).

The charging step is a step of uniformly charging the surface of the latent image bearing member, and can be performed by, for example, applying a voltage to the surface of the latent image bearing member (1) using the charging device (2).

The charging device (2) is not particularly limited and may be appropriately selected depending on the intended purpose. Examples thereof include contact-type chargers known per se having, for example, a conductive or semiconductive roller, a brush, a film and a rubber blade; and non-contact-type chargers utilizing colona discharge such as corotron and scorotron.

The charging device (2) may be a charging roller as well as a magnetic brush, a fur brush, etc. The shape thereof may be suitably selected according to the specification or configuration of an electrophotographic apparatus. When a magnetic brush is used as the charging device, the magnetic brush is composed of a charging member of various ferrite particles such as Zn—Cu ferrite, a non-magnetic conductive sleeve to support the ferrite particles, and a magnetic roller included in the non-magnetic conductive sleeve. Also, the fur brush is, for example, a fur treated to be conductive with, for example, carbon, copper sulfide, a metal or a metal oxide, and the fur is coiled or mounted to a metal or a metal core which is treated to be conductive, thereby obtaining the charging device.

The charging device (2) is not limited to the aforementioned contact-type chargers. However, the contact-type chargers are preferably used from the viewpoint of reducing the amount of ozone generated from the charger in the image forming apparatus.

The exposing step is a step of exposing the charged surface of the latent image bearing member based on the image data to form a latent electrostatic image, and can be performed by, for example, imagewise exposing the photoconductor surface with the exposing device (3). The exposing device (3) is not particularly limited and may be appropriately selected depending on the intended purpose, so long as it attains desired imagewise exposure to the surface of the latent image bearing member (1) charged with the charging device (2). Examples thereof include various exposing devices such as a copy optical exposing device, a rod lens array exposing device, a laser optical exposing device and a liquid crystal shutter exposing device.

The developing step is a step of developing, with a toner, the latent electrostatic image formed on the surface of the latent image bearing member to form a visible image, and can be performed by, for example, developing the latent electrostatic image with the toner of the present invention using the developing unit (4). The developing unit (4) is not particularly limited, so long as it attains development using the toner of the present invention, and may be appropriately selected from known developing units. Preferred examples of the developing units include those having a developing device which has the toner of the present invention therein and which can apply the toner to the latent electrostatic image in a contact or non-contact manner.

The developing unit (4) preferably has a developing roller (40) and a thin layer-forming member (41). Here, the developing roller (40) has a toner on the circumferential surface thereof and supplies the toner to the latent electrostatic image formed on the latent image bearing member (1) while being rotated together with the latent image bearing member (1) the developing roller (40) is in contact with. The thin layer-forming member (41) comes into contact with the circumferential surface of the developing roller (40) to form a thin layer of the toner on the developing roller (40).

The developing roller (40) used is preferably a metal roller or elastic roller. The metal roller is not particularly limited and may be appropriately selected depending on the intended purpose. Examples thereof include an aluminum roller. By treating the metal roller through blast treatment, the developing roller (40) having a desired surface friction coefficient can be formed relatively easily. Specifically, an aluminum roller can be treated through glass bead blasting to roughen the roller surface. The thus-obtained developing roller can attach an appropriate amount of toner thereonto.

The elastic roller used is a roller coated with an elastic rubber layer. The roller is further provided thereon with a surface coat layer made of a material that is easily chargeable at the opposite polarity to that of the toner. The hardness of the elastic rubber layer is set to be equal to or lower than 60° according to JIS-A, in order to prevent the toner from being degraded due to pressure concentration at a contact region between the elastic rubber layer and the thin layer-forming member (41). The surface roughness (Ra) of the elastic rubber layer is set to be 0.3 μm to 2.0 μm so as to retain, on its surface, the toner in a necessary amount. Also, since the developing roller (40) receives a developing bias for forming an electrical field between the developing roller (40) and the latent image bearing member (1), the resistance of the elastic rubber layer is set to be $10^3\Omega$ to $10^{10}\Omega$. The developing roller (40) is rotated counterclockwise to convey the toner retained thereon to positions where the developing roller (40) faces the thin layer forming member (41) and the latent image bearing member (1).

The thin layer-forming member (41) is provided downstream of the contact region between the supply roller (42) and the developing roller (40) in a direction in which the developing roller (40) is rotated. The thin layer-forming member (41) is a metal plate spring of stainless steel (SUS), phosphor bronze, etc., and its free end is brought into contact with the surface of the developing roller (40) at a press force of 10 N/m to 40 N/m. The thin layer-forming member (41) forms the toner passing thereunder into a thin layer by the press force and frictionally charges the toner. In addition, for aiding frictional charging, the thin layer forming member (41) receives a regulation bias having a value offset in the same direction of the polarity of the toner against the developing bias.

The rubber elastic material forming the surface of the developing roller (40) is not particularly limited and may be appropriately selected depending on the intended purpose. Examples thereof include styrene-butadiene copolymer rubbers, butadiene copolymer rubbers, acrylonitrile-butadiene copolymer rubbers, acrylic rubbers, epichlorohydrin rubbers, urethane rubbers, silicone rubbers and blends of two or more of them. Of these, particularly preferred are blend rubbers of epichlorohydrin rubbers and acrylonitrile-butadiene copolymer rubbers.

The developing roller (40) is produced by, for example, coating the circumference of a conductive shaft with the rubber elastic material. The conductive shaft is made, for example, of a metal such as stainless steel (SUS).

The transfer step is a step of transfer the visible image on the latent image bearing member surface onto an image-receiving medium, and can be performed by, for example, charging the latent image bearing member (1) with a transfer roller. The transfer roller preferably has a primary transfer unit configured to transfer the toner image onto the intermediate transfer medium (6) to form a transfer image; and a secondary transfer unit (transfer roller (8)) configured to transfer the transfer image onto a recording paper sheet (P). More preferably, in response to the case where toners of two or more colors, preferably, full color toners are used, the transfer roller has a primary transfer unit configured to transfer the toner images onto the intermediate transfer medium (6) to form a composite transfer image; and a secondary transfer unit configured to transfer the composite transfer image onto a recording paper sheet (P).

Notably, the intermediate transfer medium (6) is not particularly limited and may be appropriately selected from known transfer media. Preferred examples thereof include a transfer belt.

The transfer unit (the primary transfer unit or the secondary transfer unit) preferably has at least a transfer device which charge-separates the toner image from the latent image bearing member (1) toward the recording paper sheet (P). The number of the transfer unit may be one or more. Examples of the transfer unit include a corona transfer device using colona discharge, a transfer belt, a transfer roller, a pressure transfer roller and an adhesive transfer device.

Notably, typical examples of the recording paper sheet (P) include plain paper. The recording paper sheet, however, is not particularly limited and may be appropriately selected depending on the intended purpose, so long as it can receive an unfixed image formed after development. Further examples of the recording paper sheet employable include PET bases for use in OHP.

The fixing step is a step of fixing the visible image on the image-receiving medium, and can be performed by, for example, fixing the toner image transferred onto the recording paper sheet (P) with a fixing unit. The fixing of the toner images of colors may be performed every time when each toner image is transferred onto the recording paper sheet (P) or at one time after the toner images of colors have been mutually superposed.

The fixing unit is not particularly limited and may be appropriately selected depending on the intended purpose. The fixing unit is preferably a known heat-press unit. Examples of the heat-press unit include a combination of a heating roller and a pressing roller and a combination of a heating roller, a pressing roller and an endless belt. Notably, the heating temperature of the heat-press unit is preferably 80° C. to 200° C.

Figure 3:
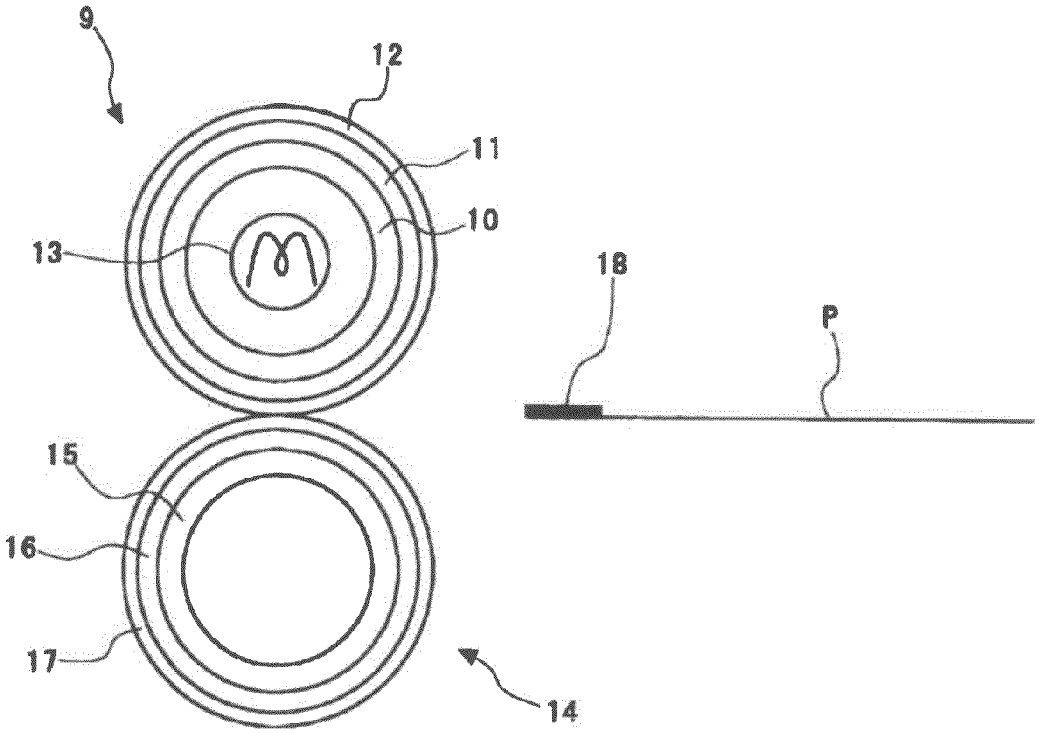
FIG. 3 is an explanatory view of the configuration of a fixing unit used in an image forming apparatus in which an electrostatic image developing toner of the present invention is used.

The fixing unit may be a soft roller-type fixing unit having fluorine-containing surface layers as illustrated in FIG. 3. This fixing unit has a heat roller (9) and a press roller (14). The heat roller (9) has an aluminum core (10), an elastic material layer (11) of silicone rubber, PFA (tetrafluoroethylene-perfluoroalkyl vinyl ether copolymer) surface layer (12) and a heater (13), where the elastic material layer (11) and the PFA surface layer (12) are provided on the aluminum core (10) and the heater (13) is provided inside the aluminum core (10). The press roller (14) has an aluminum core (15), an eleastic material layer (16) of silicone rubber and a PFA surface layer (17), where the eleastic material layer (16) and the PFA surface layer (17) are provided on the aluminum core (15). Notably, the recording paper sheet (P) having an unfixed image (18) is fed as illustrated.

Notably, in the present invention, a known optical fixing device, etc. may be used in addition to or instead of the fixing unit depending on the intended purpose.

Charge elimination is preferably performed by, for example, applying a charge-eliminating bias to the latent image bearing member with a charge-eliminating unit. The charge-eliminating unit is not particularly limited, so long as it can apply a charge-eliminating bias to the latent image bearing member, and may be appropriately selected from known charge-eliminating devices. Preferably, a charge-eliminating lamp or a similar device is used.

Cleaning is preferably performed by, for example, removing the toner remaining on the photoconductor with a cleaning unit. The cleaning unit is not particularly limited, so long as it can remove the toner remaining on the photoconductor, and may be appropriately selected from known cleaners. Preferred examples thereof include a magnetic blush cleaner, an electrostatic brush cleaner, a magnetic roller cleaner, a blade cleaner, a brush cleaner and a web cleaner.

Recycling is preferably performed by, for example, conveying the toner having been removed by the cleaning unit to the developing unit with a recycling unit. The recycling unit is not particularly limited and may be, for example, a known conveying unit.

Control is preferably performed by, for example, controlling each unit with a controlling unit. The controlling unit is not particularly limited, so long as it can control each unit, and may be appropriately selected depending on the intended purpose. Examples thereof include devices such as a sequencer and a computer.

The image forming apparatus, image forming method or process cartridge of the present invention uses the latent electrostatic image developing toner of the present invention excellent in fixing property and involving no degradation (e.g., cracks) due to stress in the developing process, and thus can provide good images.

[Multi-Color Image Forming Apparatus]

Figure 4:
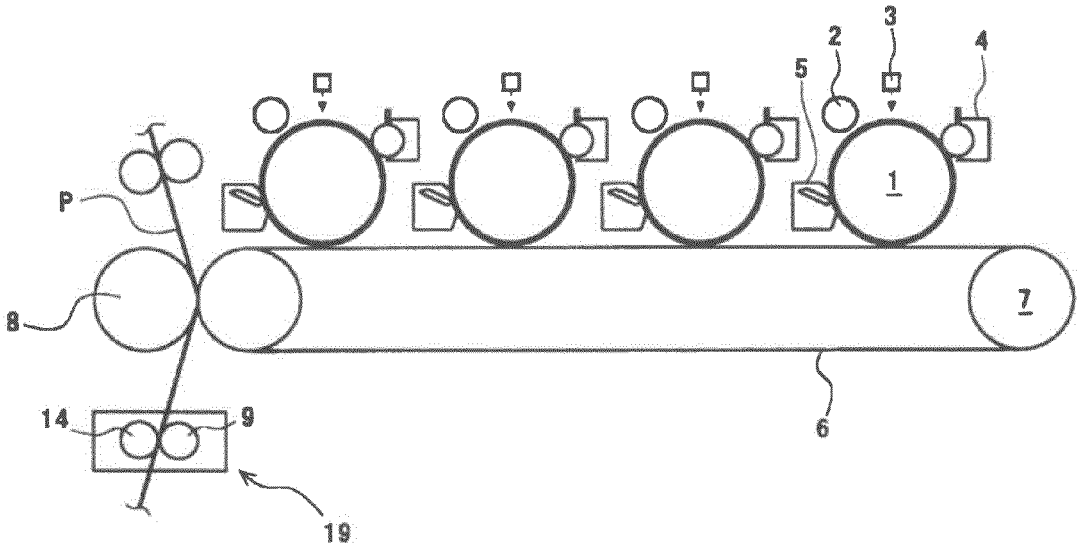
FIG. 4 is an explanatory view of another image forming apparatus in which an electrostatic image developing toner of the present invention is used.

FIG. 4 is a schematic view of an example of a multi-color image forming apparatus to which the present invention is applied. The multi-color image forming apparatus illustrated in FIG. 4 is a tandem-type full color image forming apparatus.

The image forming apparatus of FIG. 4 contains, in an unillustrated main body casing, latent image bearing members (1) rotated clockwise in FIG. 4 which are each provided therearound with a charging device (2), an exposing device (3), a developing unit (4), an intermediate transfer medium (6), a supporting roller (7), a transfer roller (8), etc. This image forming apparatus has an unillustrated paper-feeding cassette containing a plurality of recording paper sheets. The recording paper sheets (P) in the paper-feeding cassette are fed one by one with an unillustrated paper-feeding roller to between the intermediate transfer medium (6) and the transfer roller (8), followed by fixing with a fixing unit (19). Before fed to therebetween, the recording paper sheet is retained with a pair of registration rollers so that it can be fed at a desired timing.

In this image forming apparatus, while being rotated clockwise in FIG. 4, each of the latent image bearing members (1) is uniformly charged with the corresponding charging device (2). Then, the latent image bearing member (1) is irradiated with laser beams modulated by image date from the corresponding exposing device (3), to thereby form a latent electrostatic image. The latent electrostatic image formed on the latent image bearing member (1) is developed with the toner using the corresponding developing unit (4). Next, the toner image, which has formed by applying the toner to the latent image bearing member with the developing unit (4), is transferred from the latent image bearing member (1) to the intermediate transfer medium. The above-described process is performed in four colors of cyan (C), magenta (M), yellow (Y) and black (K), to thereby form a full color toner image.

Figure 5:
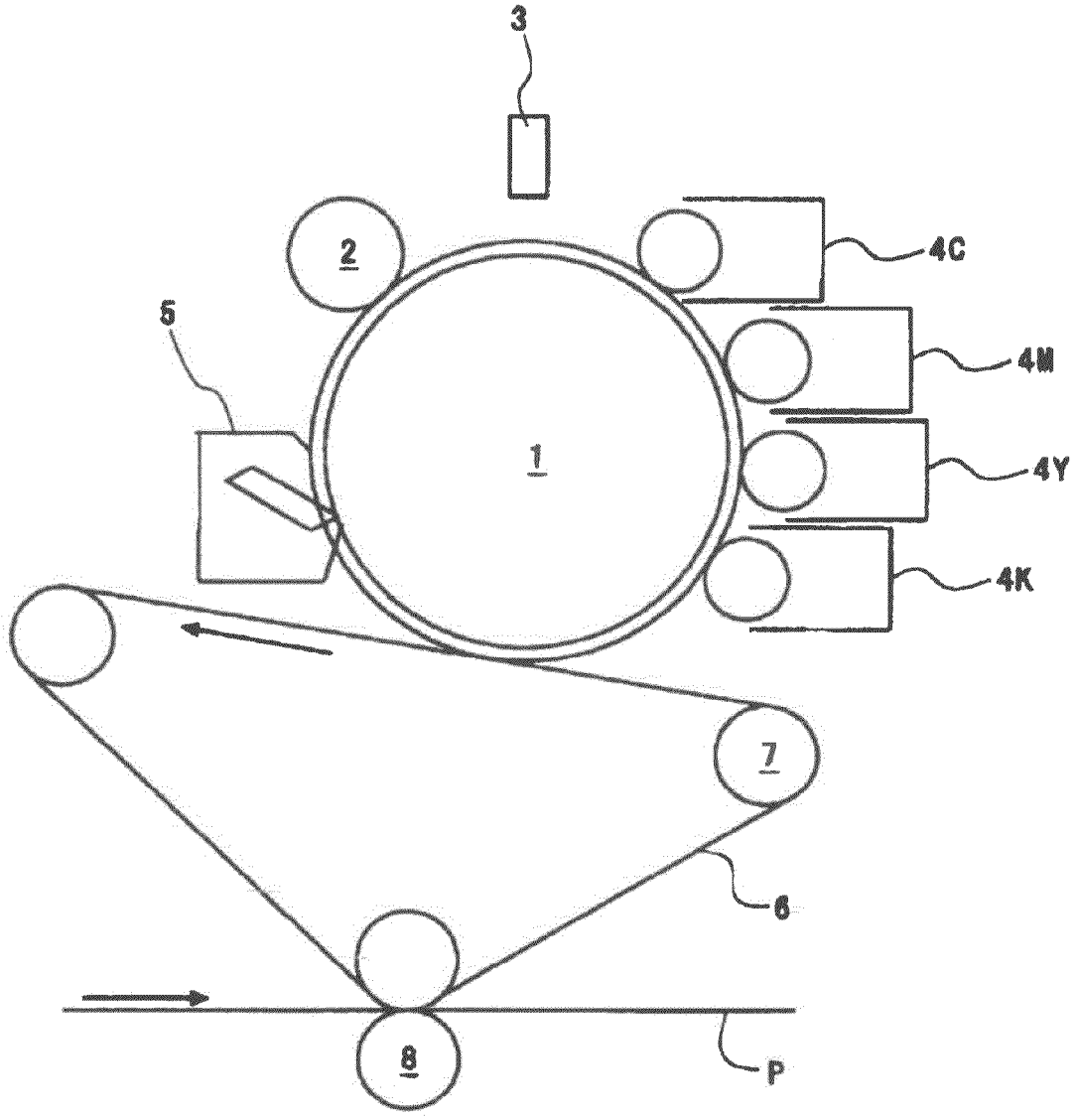
FIG. 5 is an explanatory view of still another image forming apparatus in which an electrostatic image developing toner of the present invention is used.

FIG. 5 is a schematic view of an example of a full color image forming apparatus of revolver type. This image forming apparatus switches the operation of each developing unit to sequentially apply color toners onto one latent image bearing member (1) for development. A transfer roller (8) is used to transfer the color toner image from the intermediate transfer medium (6) onto a recording paper sheet (P), which is then conveyed to a fixing part for obtaining a fixed image.

In the image forming apparatus after the toner image has been transferred from the intermediate transfer member (6) onto the recording paper sheet (P), the latent image bearing member (1) is further rotated to reach a cleaning part (5) where the toner remaining on the surface of the latent image bearing member (1) is scraped off by a blade, followed by charge-eliminating. Then, the image forming apparatus uniformly charges, with the charging device (2), the latent image bearing member (1) charge-eliminated by the charge-eliminating device, and performs the next image formation in the same manner as described above. Notably, the cleaning part (5) is limited to the part where the toner remaining on the latent image bearing member (1) is scraped off by a blade. For example, the cleaning part (5) may be a part where the toner remaining on the latent image bearing member (1) is scraped off by a fur brush.

The image forming method or image forming apparatus of the present invention uses as a developer the toner of the present invention, and thus can provide good images.

(Process Cartridge)

A process cartridge of the present invention includes at least a latent electrostatic image bearing member and a developing unit configured to develop a latent electrostatic image formed on the surface of the latent image bearing member with the toner of the present invention to form a visible image; and, if necessary, further includes appropriately selected other units such as a charging unit, a developing unit, a transfer unit, a cleaning unit and a charge-eliminating unit, wherein the process cartridge is detachably mounted to the main body of an image forming apparatus.

The developing unit has at least the toner of the present invention or a toner container housing the toner, and a developer bearing member which bears and conveys the toner or a toner-containing developer housed in the toner container; and optionally includes, for example, a layer thickness-regulating member for regulating the layer thickness of the toner on the developer bearing member. The process cartridge of the present invention can be mounted detachably to various electrophotographic apparatuses, facsimiles and printers. Preferably, it is mounted detachably to the above-described image forming apparatus of the present invention.

Figure 6:
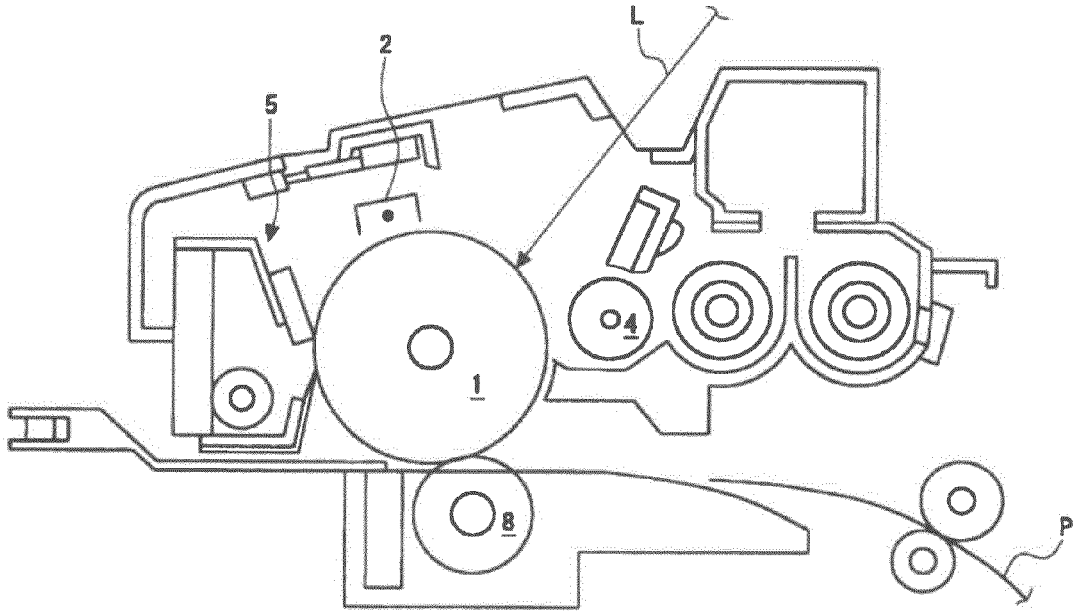
FIG. 6 is an explanatory view of a process cartridge in which an electrostatic image developing toner of the present invention is used.

As illustrated in FIG. 6, the process cartridge includes a latent image bearing member (1), a charging device (2), a developing unit (4), a transfer roller (8) and a cleaning part (5); and, if necessary, further includes other units. In FIG. 6, (L) denotes light emitted from an unillustrated exposing device and (P) denotes a recording paper sheet. The latent image bearing member (1) may be the same as that used in the above-described image forming apparatus. The charging device (2) may be any charging member.

Next, description will be given to image forming process by the process cartridge illustrated in FIG. 6. While being rotated clockwise, the latent image bearing member (1) is charged with the charging device (2) and then is exposed to light (L) emitted from the unillustrated exposing unit. As a result, a latent electrostatic image in response to an exposure pattern is formed on the surface of the latent image bearing member (1). The latent electrostatic image is developed with the toner in the developing unit (4). The developed toner image is transferred with the transfer roller (8) onto the recording paper sheet (P), which is then printed out. Next, the latent image bearing member surface from which the toner image has been transferred is cleaned in the cleaning part (5), and is charge-eliminated with an unillustrated charge-eliminating unit. The above-described process is repeatedly performed.

<Measurement of Particle Diameter of Toner>

The volume average particle diameter of the toner is measured by the Coulter counter method. Examples of employable measurement apparatus include a Coulter Counter TA-II, Coulter Multisizer II and Coulter Multisizer III (these products are of Coulter, Inc.). The measurement method will next be described.

First, a surfactant (0.1 mL to 5 mL), preferably an alkylbenzene sulfonic acic salt, is added as a dispersing agent to an electrolyte solution (100 mL to 150 mL). Here, the electrolyte solution is an about 1% by mass aqueous NaCl solution prepared using 1st grade sodium chloride, and examples of commercially available products thereof include ISOTON-II (product of Coulter, Inc.). Subsequently, a measurement sample (2 mg to 20 mg) is suspended in the above-obtained electrolyte solution. The resultant electrolyte solution is dispersed with an ultrasonic wave disperser for about 1 min to about 3 min. The thus-obtained dispersion liquid is analyzed with the above-described apparatus using an aperture of 100 μm to measure the number or volume of the toner particles. Then, the volume particle size distribution and number particle size distribution are calculated from the obtained values. From these distributions, the volume average particle diameter and number average particle diameter of the toner can be obtained.

Notably, in this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) are subjected to the measurement.

The toner particles of the present invention preferably have a volume average particle diameter of 3 μm to 9 μm, preferably 4 μm to 8 μm, more preferably 4 μm to 7 in order for the toner particles to be changed uniformly and sufficiently. The toner particles having a volume average particle diameter less than 3 μm are relatively increased in toner adhesion force, which is not preferred since the toner operability is reduced under an electrical field. The toner particles having a volume average particle diameter exceeding 9 μm form an image whose image qualities (e.g., reproducibility of thin lines) are degraded.

Also, in the toner, the ratio of the volume average particle diameter to the number average particle diameter (volume average particle diameter/number average particle diameter) is preferably 1.25 or less, more preferably 1.20 or less, still more preferably 1.17 or less. When the ratio therebetween exceeds 1.25; i.e., the toner particles have low uniformity in particle diameter, the size or height of the protrusions tends to be varied. In addition, during repetitive use, toner particles having a large particle diameter or, in some cases, toner particles having small particle diameter are preferentially consumed, so that the average particle diameter of the toner particle remaining in the developing unit is changed from that of the toner particles at an initial state. Thus, the developing conditions initially set are not optimal for development of the remaining toner particles. As a result, various unfavorable phenomena tend to occur including charging failure, considerable increase or decrease of the amount of toner particles conveyed, toner clogging and toner leakage.

<Measurement of Average Sphericity of Toner>

The average sphericity of the toner can be measured using a flow-type particle image analyzer FPIA-2000. Specifically, 0.1 mL to 0.5 mL of a surfactant (preferably an alkylbenzene sulfonic acid salt) is added as a dispersing agent into 100 mL to 150 mL of water in a container, from which solid impurities have previously been removed. Then, about 0.1 g to about 0.5 g of a measurement sample is added to the container, followed by dispersing. The resultant suspension is subjected to dispersing treatment by an ultrasonic disperser for about 1 min to about 3 min, and the concentration of the dispersion liquid is adjusted such that the number of particles of the sample is 3,000 per microliter to 10,000 per microliter. In this state, the shape and distribution of the toner are measured using the analyzer.

The toner preferably has an average sphericity of 0.930 or more, more preferably 0.950 or more, particularly preferably 0.970 or more. The toner having an average sphericity less than 0.930 is poor in flowability to easily cause failures upon development as well as to be degraded in transfer efficiency.

<Measurement of Particle Diameter of Vinyl Fine Resin Particles>

The particle diameter of the fine resin particles was measured using UPA-150EX (product of NIKKISO CO., LTD.).

The fine resin particles preferably have a particle diameter of 50 nm to 200 nm, more preferably 80 nm to 160 nm, particularly preferably 100 nm to 140 nm. When the particle diameter is smaller than 50 nm, it is difficult to form sufficiently large protrusions on the toner surface. When the particle diameter exceeds 200 nm, the formed protrusions become ununiform, which is not preferred. Also, in the fine resin particles, the ratio of the volume average particle diameter to the number average particle diameter (volume average particle diameter/number average particle diameter) is preferably 1.25 or less, more preferably 1.20 or less, still more preferably 1.17 or less. When the particle diameter of the fine resin particles exceeds 1.25; i.e., the fine resin particles are poor in uniformity of particle diameter, the embedment rates of the formed protrusions tend to be varied.

<Measurement of Molecular Weight (GPC)>

The molecular weight of the resin was measured through GPC (gel permeation chromatography) under the following conditions.

Apparatus: GPC-150C (product of Waters Co.)
Column: KF801 to 807 (product of Shodex Co.)
Temperature: 40° C.
Solvent: THF (tetrahydrofuran)
Flow rate: 1.0 mL/min
Sample injected: 0.1 mL of a sample having a concentration of 0.05% to 0.6%

From the molecular weight distribution of the resin measured under the above conditions, the number average molecular weight and the weight average molecular weight of the resin were calculated using a molecular weight calibration curve obtained from monodispersed polystyrene standard samples. The standard polystyrene samples used for obtaining the calibration curve were toluene and Std. Nos. S-7300, S-210, S-390, S-875, S-1980, S-10.9, S-629, S-3.0 and S-0.580 of Showdex STANDARD (product of SHOWA DENKO K.K.). The detector used was a R1 (refractive index) detector.

<Measurement of Glass Transition Temperature (Tg) (DSC)>

The Tg was measured using TG-DSC system TAS-100 (product of Rigaku Denki Co., Ltd.).

A sample (about 10 mg) is placed in an aluminum container, which is placed on a holder unit. The holder unit is then set in an electric oven. The sample is heated from room temperature to 150° C. at a temperature increasing rate of 10° C./min, left to stand at 150° C. for 10 min, cooled to room temperature, and left to stand for 10 min. In a nitrogen atmosphere, the sample is heated again to 150° C. at a temperature increasing rate of 10° C./min for DSC analysis. Using the analysis system of TAS-100 system, the Tg is calculated from the tangent point between the base line and the tangential line of the endothermic curve near the Tg.

<Measurement of Acid Value>

The acid value of the resin is measured according to JIS K1557-1970, which will be specifically described below.

About 2 g of a pulverized sample is accurately weighed (W (g)).

The sample is added to a 200 mL conical flask. Then, 100 mL of a solvent mixture of toluene/ethanol (2:1 by volume) is added to the flask. The resultant mixture is left to stand for 5 hours for dissolution. A phenolphthalein solution serving as an indicator is added to the solution.

The resultant solution is titrated with 0.1N alcohol solution of potassium hydroxide. The amount of the KOH solution is defined as S (mL).

A blank test is performed, and the amount of the KOH solution is defined as B (mL).

The acid value is calculated using the following equation:

$$\text{Acid value}=[(S-B)\times f\times 5.61]/W$$

where f denotes a factor of the KOH solution.

<Measurement of Concentration of Solid Matter>

The concentration of solid matter contained in the oil phase was measured as follows.

An aluminum plate (about 1 g to about 3 g) is accurately weighed in advance. About 2 g of the oil phase is placed on the aluminum plate within 30 sec, and then the oil phase placed thereon is accurately weighed. The aluminum plate is placed for 1 hour in an oven set to 150° C. to evaporate the solvent. Thereafter, the aluminum plate is taken out from the oven and left to cool. Subsequently, the total mass of the aluminum plate and solid matter of the oil phase is measured with an electronic balance. The mass of the aluminum plate is subtracted from the total mass of the aluminum plate and the solid matter contained in the oil phase to obtain the mass of the solid matter contained in the oil phase, which is divided by the mass of the oil phase placed on the aluminum plate to obtain the concentration of the solid matter contained in the oil phase. Also, the ratio of the solvent to the solid matter contained in the oil phase is a value obtained from the following: (the mass of the oil phase—the mass of the solid matter contained in the oil phase); i.e., the mass of the solvent/the mass of the solid matter contained in the oil phase.

<Measurement of Embedment Rate of Fine Resin Particles>

The average embedment rate and average sphericity of the fine resin particles were measured as follows.

An epoxy resin curable within 30 min is dropped on a stub specialized for an apparatus, and left to stand for 30 min. A sample is applied onto the epoxy resin and left to stand for one day or longer. The sample is cut with an ultramicrotome (product of Ultrasonic Co.) to form cross-sectional surfaces of toner particles. The cross-sectional surfaces are observed under a scanning transmission electron microscope (STEM) or Schottky field emission scanning transmission electron microscope (Schottky FE-SEM). The obtained cross-sectional images were processed using image analysis particle size distribution measurement software "Mac-View" (product of Mountech Co., Ltd.) to measure 100 or more fine resin particles for average embedment rate and average sphericity.

Specifically, the cross-sectional images were used to measure the total areas of the fine resin particles embedded in or attached onto the toner core particles and the areas of parts embedded in the toner core particles. The thus-measured areas were used to calculate the embedment rate for each fine particle. Then, the embedment rates of the 100 or more fine resin particles were averaged to calculate the average embedment rate (or an average of the embedment rates). Regarding the particle diameter of the fine resin particles as being sufficiently smaller than that of the toner core particles, the boundaries between the exposed regions and the embedded regions of the fine resin particles are approximated by a plane. The average embedment rate of the fine resin particles is preferably 40% to 80%, more preferably 45% to 75%, particularly preferably 50% to 70%. When the average embedment rate is less than 40%, such problems as filming and adhesion arise as a result of exfoliation or cracking of the fine resin particles. In addition, the formed toner is degraded in, for example, chargeability, cleanability and heat-resistance storage stability. Whereas when the average embedment rate exceeds 80%, satisfactory effects of the protrusions are not easily obtained. Needless to say, both cases are not preferred.

Also, the average sphericity of the fine resin particles is preferably 0.90 or higher, more preferably 0.92 or higher, particularly preferably 0.94 or higher. When the average sphericity of the fine resin particles is lower than 0.90, stress applied to the protrusions tends to cause exfoliation or cracking of the fine resin particles leading to failures, which is not preferred.

EXAMPLES

The present invention will next be described by way of Examples, which should not be construed as limiting the present invention thereto. In the following Examples, the unit "part(s)" is part(s) by mass and the unit "%" is % by mass.

<Preparation of Fine Resin Particle Dispersion Liquid 1>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.6 parts) in ion-exchange water (104 parts) was added to the resultant solution. Fifteen minutes after the addition, a monomer mixture of a styrene monomer (200 parts) and n-octanethiol (4.2 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 1] having a volume average particle diameter of 122 nm. Subsequently, 2 mL of the thus-obtained [fine resin particle dispersion liquid 1] was added to a petri dish, where the dispersion medium was evaporated. The obtained dry product was measured for number average molecular weight, weight average molecular weight and Tg, which were found to be 8,300, 16,900 and 84° C., respectively.

<Preparation of Fine Resin Particle Dispersion Liquid 2>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.6 parts) in ion-exchange water (104 parts) was added to the resultant solution. Fifteen minutes after the addition, a monomer mixture of a styrene monomer (170 parts), butyl acrylate (30 parts) and n-octanethiol (4.2 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 2] having a volume average particle diameter of 135 nm. Subsequently, 2 mL of the thus-obtained [fine resin particle dispersion liquid 2] was added to a petri dish, where the dispersion medium was evaporated.

The obtained dry product was measured for number average molecular weight, weight average molecular weight and Tg, which were found to be 8,600, 17,300 and 55° C., respectively.

<Preparation of Fine Resin Particle Dispersion Liquid 3>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.7 parts) in ion-exchange water (108 parts) was added to the resultant solution. Fifteen minutes after the addition, a monomer mixture of a styrene monomer (168 parts), butyl acrylate (28 parts) and methyl methacrylate (4 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 3] having a volume average particle diameter of 117 nm. Subsequently, 2 mL of the thus-obtained [fine resin particle dispersion liquid 3] was added to a petri dish, where the dispersion medium was evaporated. The obtained dry product was measured for number average molecular weight, weight average molecular weight and Tg, which were found to be 9,000, 31,000 and 61° C., respectively.

<Preparation of Fine Resin Particle Dispersion Liquid 4>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.5 parts) in ion-exchange water (98 parts) was added to the resultant solution. Fifteen minutes after the addition, a monomer mixture of a styrene monomer (160 parts) and [compound 1] having the following Chemical Formula (1) (40 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 4] having a volume average particle diameter of 115 nm. Subsequently, 2 mL of the thus-obtained [fine resin particle dispersion liquid 4] was added to a petri dish, where the dispersion medium was evaporated. The obtained dry product was measured for number average molecular weight, weight average molecular weight and Tg, which were found to be 98,400, 421,900 and 70° C., respectively.

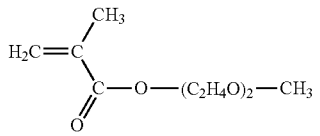

(1)

<Preparation of Fine Resin Particle Dispersion Liquid 5>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.7 parts) in ion-exchange water (108 parts) was added to the resultant solution. Fifteen minutes after the addition, a monomer mixture of a styrene monomer (160 parts) and methyl methacrylate (40 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 5] having a volume average particle diameter of 100 nm. Subsequently, 2 mL of the thus-obtained [fine resin particle dispersion liquid 5] was added to a petri dish, where the dispersion medium was evaporated. The obtained dry product was measured for number average molecular weight, weight average molecular weight and Tg, which were found to be 60,000, 215,500 and 99° C., respectively.

<Preparation of Fine Resin Particle Dispersion Liquid 6>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.5 parts) in ion-exchange water (101 parts) was added to the resultant solution. Fifteen minutes after the addition, a monomer mixture of a styrene monomer (170 parts) and butyl acrylate (30 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 6] having a volume average particle diameter of 113 nm. Subsequently, 2 mL of the thus-obtained [fine resin particle dispersion liquid 6] was added to a petri dish, where the dispersion medium was evaporated. The obtained dry product was measured for number average molecular weight, weight average molecular weight and Tg, which were found to be 68,700, 317,600 and 75° C., respectively.

<Preparation of Fine Resin Particle Dispersion Liquid 7>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.6 parts) in ion-exchange water (102 parts) was added to the resultant solution. Fifteen minutes after the addition, a monomer mixture of a styrene monomer (184.6 parts), butyl acrylate (15 parts) and divinyl benzene (0.5 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 7] having a volume average particle diameter of 79 nm. Subsequently, 2 mL of the thus-obtained [fine resin particle dispersion liquid 7] was added to a petri dish, where the dispersion medium was evaporated. The obtained dry product was measured for number average molecular weight, weight average molecular weight and Tg, which were found to be 33,900, 160,800 and 87° C., respectively.

<Preparation of Fine Resin Particle Dispersion Liquid 8>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.5 parts) in ion-exchange water (101 parts) was added to the resultant solution. Fifteen minutes after the addition, a monomer mixture of a styrene monomer (169 parts), butyl acrylate (30 parts) and divinyl benzene (1 part) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 8] having a volume average particle diameter of 100 nm. Subsequently, 2 mL of the thus-obtained [fine resin particle dispersion liquid 8] was added to a petri dish, where the dispersion medium was evaporated. The obtained dry product was measured for number average molecular weight, weight average molecular weight and Tg, which were found to be 31,300, 88,300 and 75° C., respectively.

<Preparation of Fine Resin Particle Dispersion 9>

Fine polyester particles ACP-04 (product of FUJIKURA KASEI CO., LTD.) were used as [fine resin particle dispersion 9].

<Preparation of Fine Resin Particle Dispersion 10>

Fine PMMA particles MP-400 (product of Soken Chemical & Engineering Co., Ltd.) were used as [fine resin particle dispersion 10].

<Preparation of Fine Resin Particle Dispersion Liquid 11>

A polyester resin dispersion liquid RTP-2 (product of TOYOBO CO., LTD.) was used as [fine resin particle dispersion liquid 11].

<Preparation of Fine Resin Particle Dispersion Liquid 12>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.5 parts) in ion-exchange water (98 parts) was added to the resultant solution. Fifteen minutes after the addition, a monomer mixture of a styrene monomer (130 parts) and [compound 1] having the above Chemical Formula (1) (70 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 12] having a volume average particle diameter of 115 nm. Subsequently, 2 mL of the thus-obtained [fine resin particle dispersion liquid 12] was added to a petri dish, where the dispersion medium was evaporated. The obtained dry product was measured for number average molecular weight, weight average molecular weight and Tg, which were found to be 87,600, 391,700 and 48° C., respectively.

<Preparation of Fine Resin Particle Dispersion Liquid 13>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.8 parts) in ion-exchange water (111 parts) was added to the resultant solution. Fifteen minutes after the addition, a monomer mixture of a styrene monomer (130 parts) and methyl methacrylate (70 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 13] having a volume average particle diameter of 122 nm. Subsequently, 2 mL of the thus-obtained [fine resin particle dispersion liquid 13] was added to a petri dish, where the dispersion medium was evaporated. The obtained dry product was measured for number average molecular weight, weight average molecular weight and Tg, which were found to be 61,900, 183,500 and 99° C., respectively.

<Preparation of fine resin particle dispersion liquid 14>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.6 parts) in ion-exchange water (104 parts) was added to the resultant solution. Fifteen minutes after the addition, a monomer mixture of a styrene monomer (200 parts) and n-octanethiol (14 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 14] having a volume average particle diameter of 143 nm. Subsequently, 2 mL of the thus-obtained [fine resin particle dispersion liquid 14] was added to a petri dish, where the dispersion medium was evaporated. The obtained dry product was measured for number average molecular weight, weight average molecular weight and Tg, which were found to be 2,700, 6,100 and 44° C., respectively.

<Preparation of Fine Resin Particle Dispersion Liquid 15>

A reaction container equipped with a condenser, a stirrer and a nitrogen-introducing pipe was charged with sodium lauryl sulfate (0.7 parts) and ion-exchange water (498 parts), followed by heating to 80° C. under heating for dissolution. Then, a solution of potassium persulfate (2.6 parts) in ion-exchange water (104 parts) was added to the resultant solution. Fifteen minutes after the addition, a monomer mixture containing a styrene monomer (200 parts) was added dropwise to the resultant mixture for 90 min. Subsequently, the temperature of the mixture was maintained at 80° C. for 60 min to perform polymerization reaction.

Then, the reaction mixture was cooled to obtain white [fine resin particle dispersion liquid 15] having a volume average particle diameter of 100 nm. Subsequently, 2 mL of the thus-obtained [fine resin particle dispersion liquid 15] was added to a petri dish, where the dispersion medium was evaporated. The obtained dry product was measured for number average molecular weight, weight average molecular weight and Tg, which were found to be 61,700, 215,200 and 101° C., respectively.

<Synthesis of Polyester 1>

A reaction container equipped with a condenser, a stirrer and a nitrogen-introducing pipe was charged with bisphenol A ethylene oxide 2 mol adduct (229 parts), bisphenol A propylene oxide 2 mol adduct (529 parts), terephthalic acid (208 parts), adipic acid (46 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg. Then, trimellitic anhydride (44 parts) was added to the reaction container, followed by reaction at 180° C. for 2 hours under normal pressure, to thereby synthesize [polyester 1]. The thus-obtained [polyester 1] was found to have a number average molecular weight of 2,500, a weight average molecular weight of 6,700, a glass transition temperature of 43° C. and an acid value of 25 mgKOH/g.

<Synthesis of Polyester 2>

A reaction container equipped with a condenser, a stirrer and a nitrogen-introducing pipe was charged with bisphenol A ethylene oxide 2 mol adduct (264 parts), bisphenol A propylene oxide 2 mol adduct (523 parts), terephthalic acid (123 parts), adipic acid (173 parts) and dibutyl tinoxide (1 part), followed by reaction at 230° C. for 8 hours under normal pressure. Next, the reaction mixture was allowed to react for 8 hours under a reduced pressure of 10 mmHg to 15 mmHg. Then, trimellitic anhydride (26 parts) was added to the reaction container, followed by reaction at 180° C. for 2 hours under normal pressure, to thereby systhesize [polyester 2]. The thus-obtained [polyester 2] was found to have a number average molecular weight of 4,000, a weight average molecular weight of 47,000, a glass transition temperature of 65° C. and an acid value of 12 mgKOH/g.

<Synthesis of Polyester 3>

A reaction container equipped with a condenser, a stirrer and a nitrogen-introducing pipe was charged with bisphenol A ethylene oxide 2 mol adduct (218 parts), bisphenol A propylene oxide 2 mol adduct (460 parts), terephthalic acid (140 parts), isophthalic acid (145 parts) and dibutyl tinoxide (2 parts), followed by reaction at 230° C. for 8 hours under normal pressure. Next, the reaction mixture was allowed to react for 6 hours under a reduced pressure of 10 mmHg to 18 mmHg. Then, trimellitic anhydride (24 parts) was added to the reaction container, followed by reaction at 180° C. for 2 hours under normal pressure, to thereby systhesize [polyester 3]. The thus-obtained [polyester 3] was found to have a number average molecular weight of 7,600, a weight average molecular weight of 21,000, a glass transition temperature of 57° C. and an acid value of 20 mgKOH/g.

<Synthesis of Polyester 4>

A reaction container equipped with a condenser, a stirrer and a nitrogen-introducing pipe was charged with bisphenol A ethylene oxide 2 mol adduct (553 parts), bisphenol A propylene oxide 2 mol adduct (196 parts), terephthalic acid (220 parts), adipic acid (45 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg. Then, trimellitic anhydride (46 parts) was added to the reaction container, followed by reaction at 180° C. for 2 hours under normal pressure, to thereby systhesize [polyester 4]. The thus-obtained [polyester 4] was found to have a number average molecular weight of 2,200, a weight average molecular weight of 5,600, a glass transition temperature of 43° C. and an acid value of 13 mgKOH/g.

<Synthesis of Polyester 5>

A reaction container equipped with a condenser, a stirrer and a nitrogen-introducing pipe was charged with bisphenol A ethylene oxide 2 mol adduct (82 parts), bisphenol A propylene oxide 2 mol adduct (69 parts), terephthalic acid (294 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg, to thereby systhesize [polyester 5]. The thus-obtained [polyester 5] was found to have a number average molecular weight of 2,100, a weight average molecular weight of 5,600, a glass transition temperature of 60° C. and an acid value of 45 mgKOH/g.

<Synthesis of Isocyanate-Modified Polyester 1>

A reaction container equipped with a condenser, a stirrer and a nitrogen-introducing pipe was charged with bisphenol A ethylene oxide 2 mol adduct (682 parts), bisphenol A propylene oxide 2 mol adduct (81 parts), terephthalic acid (283 parts), trimillitic anhydride (22 parts) and dibutyl tinoxide (2 parts), followed by reaction at 230° C. for 8 hours under normal pressure. Next, the reaction mixture was allowed to react for 5 hours under a reduced pressure of 10 mmHg to 15 mmHg, to thereby synthesize [intermediate polyester 1]. The thus-obtained [intermediate polyester 1] was found to have a number average molecular weight of 2,200, a weight average molecular weight of 9,700, a glass transition temperature of 54° C., an acid value of 0.5 mgKOH/g and a hydroxyl value of 52 mgKOH/g.

Next, a reaction container equipped with a condenser, a stirrer and a nitrogen-introducing pipe was charged with [intermediate polyester 1] (410 parts), isophorone diisocyanate (89 parts) and ethyl acetate (500 parts), followed by reaction at 100° C. for 5 hours, to thereby obtain [isocyanate-modified polyester 1].

<Preparation of Masterbatch>

Carbon black (REGAL 400R, product of Cabot Corporation) (40 parts), a binder resin (polyester resin) (60 parts) (RS-801, product of Sanyo Chemical Industries, Ltd., acid value: 10, Mw: 20,000, Tg: 64° C.) and water (30 parts) were mixed together using HENSCHEL MIXER, to thereby obtain a mixture containing pigment aggregates impregnated with water. The obtained mixture was kneaded for 45 min with a two-roll mill whose roll surface temperature had been adjusted to 130° C. The kneaded product was pulverized with a pulverizer so as to have a size of 1 mm, whereby [masterbatch 1] was obtained.

Example 1

Preparation Step of Oil Phase

A container to which a stirring rod and a thermometer had been set was charged with [polyester 1] (545 parts), [paraffin wax (melting point: 74° C.)] (181 parts) and ethyl acetate (1,450 parts). The mixture was increased in temperature to 80° C. under stirring, maintained at 80° C. for 5 hours, and cooled to 30° C. for 1 hour. Then, the container was charged with [masterbatch 1] (500 parts) and ethyl acetate (100 parts), followed by mixing for 1 hour, to thereby obtain [raw material solution 1].

[Raw material solution 1] (1,500 parts) was placed in a container, where the pigment and the wax were dispersed with a bead mill ("ULTRA VISCOMILL," product of AIMEX CO., Ltd.) under the following conditions: a liquid feed rate of 1 kg/hr, disc circumferential velocity of 6 m/s, 0.5 mm-zirconia beads packed to 80% by volume, and 3 passes. Next, a 66% by mass ethyl acetate solution of [polyester 2] (655 parts) was added thereto, and passed once with the bead mill under the above conditions, to thereby obtain [pigment/wax dispersion liquid 1].

[Pigment/wax dispersion liquid 1] (976 parts) was mixed for 1 min at 5,000 rpm with a TK homomixer (product of Tokushu Kika Kogyo Co., Ltd.). Then, [isocyanate-modified polyester 1] (88 parts) was added to the [pigment/wax dispersion liquid 1]. The resultant mixture was mixed for 1 min at 5,000 rpm with a TK homomixer (product of Tokushu Kika Kogyo Co., Ltd.), to thereby obtain [oil phase 1]. Through measurement, the solid content of [oil phase 1] was found to be 52.0% by mass, and the amount of ethyl acetate in the solid content was found to be 92% by mass.

<Preparation of Aqueous Phase>

Ion-exchange water (970 parts), 40 parts of 25% aqueous dispersion liquid of fine organic resin particles for stabilizing dispersion (a copolymer of styrene-methacrylic acid-butyl methacrylate-sodium salt of methacrylic acid ethylene oxide adduct sulfuric acid ester), 95 parts of 48.5% aqueous solution of sodium dodecyl diphenyl ether disulfonate and 98 parts of ethyl acetate were mixed together under stirring. The resultant mixture was found to have a pH of 6.2. Then, 10% aqueous solution of sodium hydroxide was added dropwise thereto to adjust the pH to 9.5, whereby [aqueous phase 1] was obtained.

<Production Step of Toner Core Particles>

The obtained [aqueous phase 1] (1,200 parts) was added to [oil phase 1]. The resultant mixture was mixed for 2 min with a TK homomixer at 8,000 rpm to 15,000 rpm, while being adjusted to 20° C. to 23° C. in a water bath to suppress increase in temperature due to shear heat of the mixer. Thereafter, the mixture was stirred for 10 min at 130 rpm to 350 rpm using a three-one motor equipped with an anchor wing, to thereby obtain [toner core particle slurry 1] containing liquid droplets of the oil phase (toner core particles) in the aqueous phase.

<Formation of Protrusions>

First, [fine resin particle dispersion liquid 1] (106 parts) was mixed with ion-exchange water (71 parts). The resultant mixture (solid concentration: 15%) was added dropwise for 3 min to [core particle slurry 1] whose temperature was adjusted to 22° C. This addition was performed while [toner core particle slurry 1] was being stirred at 130 rpm to 350 rpm with a three-one motor equipped with an anchor wing. Thereafter, the mixture was further stirred for 30 min at 200 rpm to 450 rpm to obtain [composite particle slurry 1]. Then, 1 mL of [composite particle slurry 1] was diluted so as to have a volume of 10 mL, followed by centrifugation, whereby a transparent supernatant was obtained.

<Desolvation>

A container to which a stirrer and a thermometer had been set was charged with [composite particle slurry 1], which was desolvated with stirring at 30° C. for 8 hours to obtain [dispersion slurry 1]. A small amount of [dispersion slurry 1] was placed on a glass slide, and observed through a cover glass under an optical microscope (×200). As a result, uniform toner base particles were observed. Also, 1 mL of [dispersion slurry 1] was diluted so as to have a volume of 10 mL, followed by centrifugation, whereby a transparent supernatant was obtained.

<Washing/Drying Step>

After [dispersion slurry 1] (100 parts) had been filtrated under reduced pressure, the following treatments (1) to (4) were performed.

(1) Ion-exchange water (100 parts) was added to the filtration cake, followed by mixing with a TK homomixer (at 12,000 rpm for 10 min) and filtrating.
(2) Ion-exchange water (900 parts) was added to the filtration cake obtained in (1). The resultant mixture was mixed with a TK homomixer (at 12,000 rpm for 30 min) under application of ultrasonic vibration, followed by filtrating under reduced pressure. This treatment was repeated until the reslurry had an electrical conductivity of 10 μC/cm or lower.
(3) 10% hydrochloric acid was added to the reslurry obtained in (2) so as to have a pH of 4, followed by stirring for 30 min with a three-one motor and filtrating.
(4) Ion-exchange water (100 parts) was added to the filtration cake obtained in (3), followed by mixing with a TK homomixer (at 12,000 rpm for 10 min) and filtrating. This treatment was repeated until the reslurry had an electrical conductivity of 10 μC/cm or lower, to thereby obtain [filtration cake 1].

[Filtration cake 1] was dried with an air-circulation dryer at 45° C. for 48 hours, and then sieved with a mesh having an opening size of 75 μm to obtain [toner base 1]. Through observation of the obtained [toner base 1] under a scanning electron microscope, the vinyl resin was found to be uniformly fused with the surfaces of the toner core particles. FIG. 1A is a SEM image of the toner obtained in Example 1.

Example 2

[Toner base 2] was obtained in the same manner as in Example 1, except that [polyester 2] was changed to [polyester 3]. Through observation of the obtained [toner base 2] under a scanning electron microscope, the vinyl resin was found to be uniformly fused with the surfaces of the toner core particles.

Example 3

[Toner base 3] was obtained in the same manner as in Example 1, except that [polyester 2] was changed to [polyester 3] and that [fine resin particle dispersion liquid 1] was changed to [fine resin particle dispersion liquid 2]. Through observation of the obtained [toner base 3] under a scanning electron microscope, the vinyl resin was found to be uniformly fused with the surfaces of the toner core particles.

Example 4

[Toner base 4] was obtained in the same manner as in Example 1, except that [polyester 2] was changed to [polyester 3] and that [fine resin particle dispersion liquid 1] was changed to [fine resin particle dispersion liquid 3]. Through observation of the obtained [toner base 4] under a scanning electron microscope, the vinyl resin was found to be uniformly fused with the surfaces of the toner core particles.

Example 5

[Toner base 5] was obtained in the same manner as in Example 1, except that [polyester 2] was changed to [polyester 3] and that [fine resin particle dispersion liquid 1] was changed to [fine resin particle dispersion liquid 4]. Through observation of the obtained [toner base 5] under a scanning electron microscope, the vinyl resin was found to be uniformly fused with the surfaces of the toner core particles.

Example 6

[Toner base 6] was obtained in the same manner as in Example 1, except that [polyester 2] was changed to [polyester 3] and that [fine resin particle dispersion liquid 1] was changed to [fine resin particle dispersion liquid 5]. Through observation of the obtained [toner base 6] under a scanning electron microscope, the vinyl resin was found to be uniformly fused with the surfaces of the toner core particles.

Example 7

[Toner base 7] was obtained in the same manner as in Example 1, except that [polyester 2] was changed to [polyester 3] and that [fine resin particle dispersion liquid 1] was changed to [fine resin particle dispersion liquid 6]. Through observation of the obtained [toner base 7] under a scanning electron microscope, the vinyl resin was found to be uniformly fused with the surfaces of the toner core particles.

Example 8

[Toner base 8] was obtained in the same manner as in Example 1, except that [polyester 2] was changed to [polyester 3] and that [fine resin particle dispersion liquid 1] was changed to [fine resin particle dispersion liquid 7]. Through observation of the obtained [toner base 8] under a scanning electron microscope, the vinyl resin was found to be uniformly fused with the surfaces of the toner core particles.

Example 9

[Toner base 9] was obtained in the same manner as in Example 1, except that [polyester 2] was changed to [polyester 3] and that [fine resin particle dispersion liquid 1] was changed to [fine resin particle dispersion liquid 8]. Through observation of the obtained [toner base 9] under a scanning electron microscope, the vinyl resin was found to be uniformly fused with the surfaces of the toner core particles.

Example 10

[Toner base 10] was obtained in the same manner as in Example 1, except that [polyester 2] was changed to [polyester 3] and that [isocyanate-modified polyester 1] was not added. Through observation of the obtained [toner base 10] under a scanning electron microscope, the vinyl resin was found to be uniformly fused with the surfaces of the toner core particles.

Example 11

[Toner base 11] was obtained in the same manner as in Example 1, except that [polyester 2] was changed to [polyester 4]. Through observation of the obtained [toner base 11] under a scanning electron microscope, the vinyl resin was found to be uniformly fused with the surfaces of the toner core particles.

Example 12

[Toner base 12] was obtained in the same manner as in Example 1, except that [polyester 2] was changed to [polyester 3] and that [fine resin particle dispersion liquid 1] was changed to [fine resin particle dispersion liquid 14]. Through observation of the obtained [toner base 12] under a scanning electron microscope, the vinyl resin was found to be uniformly fused with the surfaces of the toner core particles.

Example 13

[Toner base 13] was obtained in the same manner as in Example 1, except that [polyester 2] was changed to [polyester 5]. Through observation of the obtained [toner base 13] under a scanning electron microscope, the vinyl resin was found to be uniformly fused with the surfaces of the toner core particles.

Example 14

[Toner base 14] was obtained in the same manner as in Example 1, except that [polyester 2] was changed to [polyester 3] and that [fine resin particle dispersion liquid 1] was changed to [fine resin particle dispersion liquid 15]. Through observation of the obtained [toner base 14] under a scanning electron microscope, the vinyl resin was found to be uniformly fused with the surfaces of the toner core particles.

Comparative Example 1

Figure 1B:
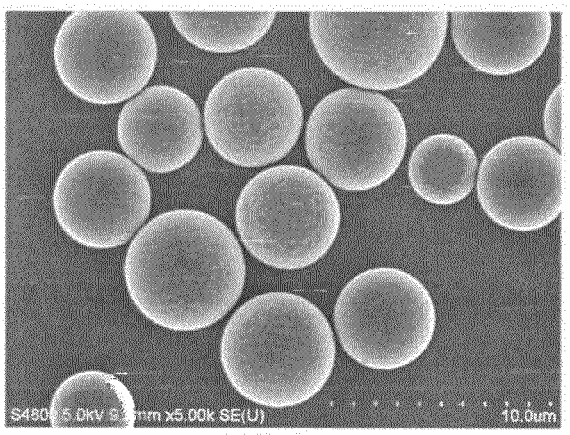
FIG. 1B is a SEM image of the toner of Comparative Example 1.

[Toner base 15] was obtained in the same manner as in Example 1, except that [fine resin particle dispersion liquid 1] was not added. Through observation of the obtained [toner base 15] under a scanning electron microscope, the toner core particles were found to have no protrusions on their surfaces. Desired protrusions were not formed on the toner surfaces, since the fine resin particle dispersion liquid necessary for forming the protrusions was not added. FIG. 1B is a SEM image of the toner obtained in Comparative Example 1.

Comparative Example 2

[Toner base 15] of Comparative Example 1 (100 parts) and [fine resin particle dispersion 9] (10 parts) were mixed together for 20 min using HENSCHEL MIXER. The resultant mixture was caused to pass through a sieve with an opening size of 60 μm to remove coarse particles and aggregates, whereby [toner base 16] was obtained. Through observation of the obtained [toner base 16] under a scanning electron microscope, [fine resin particle dispersion 9] was attached uniformly to the surfaces of the toner core particles. The average embedment rate of the fine resin particles in the surfaces of the toner core particles was found to be 2% at most, since the fine resin particles were simply attached to the surfaces mechanically.

Comparative Example 3

[Toner base 15] of Comparative Example 1 (100 parts) and [fine resin particle dispersion 10] (10 parts) were mixed together for 20 min using HENSCHEL MIXER. The resultant mixture was caused to pass through a sieve with an opening size of 60 μm to remove coarse particles and aggregates, whereby [toner base 17] was obtained. Through observation of the obtained [toner base 17] under a scanning electron microscope, [fine resin particle dispersion 10] was attached uniformly to the surfaces of the toner core particles. The average embedment rate of the fine resin particles in the surfaces of the toner core particles was found to be 6% at most, since the fine resin particles were simply attached to the surfaces mechanically.

Comparative Example 4

[Toner base 18] was obtained in the same manner as in Example 1, except that [polyester 2] was changed to [polyester 3] and that [fine resin particle dispersion liquid 1] was changed to [fine resin particle dispersion liquid 11]. Through observation of the obtained [toner base 18] under a scanning electron microscope, the toner core particles were found to have no protrusions on their surfaces. The toner core particles had so high compatibility with [fine resin particle dispersion liquid 11] that protrusions could not be formed.

Comparative Example 5

[Toner base 19] was obtained in the same manner as in Example 1, except that [polyester 2] was changed to [polyester 3], that the amount of [fine resin particle dispersion liquid 1] was changed from 106 parts to 530 parts, and that 105 parts of 48.5% aqueous solution of sodium dodecyl diphenyl ether disulfonate was added simultaneously with the addition of [fine resin particle dispersion liquid 1]. Through observation of the obtained [toner base 19] under a scanning electron microscope, the vinyl resin was found to be ununiformly attached to and fused with the surfaces of the toner core particles. Although the surfaces of the toner core particles were virtually covered with the fine resin particles, the average embedment rate was low since the protrusions became large.

Comparative Example 6

[Toner base 20] was obtained in the same manner as in Example 1, except that the amount of the 48.5% aqueous solution of sodium dodecyl diphenyl ether disulfonate in [aqueous phase 1] was changed from 95 parts to 200 parts. Through observation of the obtained [toner base 20] under a scanning electron microscope, the vinyl resin was found to be ununiformly attached to and fused with the surfaces of the toner core particles. The toner core particles were stabilized by an excess amount of the surfactant and thus, the fine resin particles were not uniformly embedded in the toner core particles, making the protrusions considerably ununiform.

Comparative Example 7

[Toner base 21] was obtained in the same manner as in Example 1, except that [fine resin particle dispersion liquid 1] was added to [aqueous phase 1]. Through observation of the obtained [toner base 21] under a scanning electron microscope, the vinyl resin was found to be ununiformly attached to and fused with the surfaces of the toner core particles. Since the fine resin particles were added before formation of the toner core particles, the fine resin particles embedded in the toner core particles became ununiform, leading to formation of ununiform protrusions.

Comparative Example 8

[Toner base 22] was obtained in the same manner as in Example 1, except that [polyester 2] was changed to [polyester 3] and that [fine resin particle dispersion liquid 1] was changed to [fine resin particle dispersion liquid 12]. Through observation of the obtained [toner base 22] under a scanning electron microscope, the vinyl resin was found to be ununiformly attached to and fused with the surfaces of the toner core particles. Since the toner core particles had high compatibility with [fine resin particle dispersion liquid 12], the protrusions became slightly large and also the average embedment rate became high.

Comparative Example 9

[Toner base 23] was obtained in the same manner as in Example 1, except that [polyester 2] was changed to [polyester 3] and that [fine resin particle dispersion liquid 1] was changed to [fine resin particle dispersion liquid 13]. Through observation of the obtained [toner base 23] under a scanning electron microscope, the vinyl resin was uniformly attached to and fused with the surfaces of the toner core particles, and almost all of each vinyl resin particle was embedded in the toner core particles. Since the toner core particles had high compatibility with [fine resin particle dispersion liquid 13], the protrusions became slightly large and also the average embedment rate became high.

Each of the above-obtained toners was evaluated by the below-described methods.

<Background Smear>

After printing of 2,000 sheets of white solid image using a color electrophotographic apparatus (IPSIO SP C220), a piece of Scotch tape was used to remove the toner attached on the photoconductor having been subjected to printing of white solid images, and the piece of tape was attached to blank paper. Then, the ΔE was measured with a spectrodensitometer and evaluated on the basis of the following 4 ranks.

A: $\Delta E<5$
B: $5\leqq\Delta E<10$
C: $10\leqq\Delta E<15$
D: $15\leqq\Delta E$ <Adhesion Resistance>

After printing of 2,000 sheets of white solid image using a color electrophotographic apparatus (IPSIO SP C220), the toner attached on the control blade was evaluated on the basis of the following 4 ranks.

A: No toner adhesion was observed, very good
B: Noticeable toner adhesion was not observed, giving no adverse effects to image quality
C: Toner adhesion was observed, giving adverse effects to image quality
D: Noticeable toner adhesion was observed, giving considerable adverse effects to image quality <Transfer Rate>

Using a color electrophotographic apparatus (IPSIO SP C220), the amount of the toner on the photoconductor and the amount of the toner of the black solid image (7.8 cm×1.0 cm) on the transfer belt were measured. The thus-measured amounts were used to calculate a transfer rate from the following equation:

Transfer rate=(the amount of the toner on the transfer belt/the amount of the toner on the photoconductor)×100

The obtained transfer rate was evaluated on the basis of the following 4 ranks.

A: 90%≦Transfer rate
B: 80%≦Transfer rate <90%
C: 70%≦Transfer rate <80%
D: Transfer rate <70%

<Transfer Uneveness>

Using a color electrophotographic apparatus (IPSIO SP C220), the black solid image (7.8 cm×1.0 cm) on the transfer belt was visually evaluated for transfer unevenness on the basis of the following 4 ranks.

A: No transfer unevenness was observed, very good
B: Transfer unevenness was observed to such an extent that image quality was not adversely affected
C: Transfer unevenness was observed to such an extent that image quality was adversely affected
D: Noticeable transfer unevenness was observed, giving great adverse effects to image quality <Cleanability>

After printing of 2,000 sheets of white solid image using a color electrophotographic apparatus (IPSIO SP C220), a white solid image was printed out and evaluated for the presence or absence of cleaning failures on the basis of the following 4 ranks.

A: No cleaning failure was observed, very good
B: Cleaning failure was observed but non-problematic in practical use
C: Cleaning failure was observed and problematic in practical use
D: Noticeable cleaning failure was observed <Minimum Fixing Temperature>

The fixing unit of a color electrophotographic apparatus (IPSIO SP C220) was used to form, on plain paper, unfixed black solid image of 1.0 mg/cm$^2$. The plain paper was passed through the fixing unit at varied heating temperatures, and the minimum temperature at which image quality was not adversely affected was defined as the minimum fixing temperature.

A: Minimum fixing temperature <140° C.
B: 140° C.≦Minimum fixing temperature <150° C.
C: 150° C.≦Minimum fixing temperature <160° C.
D: 160° C.≦Minimum fixing temperature <Hot Offset>

The fixing unit of a color electrophotographic apparatus (IPSIO SP C220) was used to form, on plain paper, unfixed black solid image of 1.0 mg/cm$^2$, followed by fixing at varied fixing temperatures. The temperature at which hot offset occurred (hot offset-occurring temperature) was measured and evaluated on the basis of the following 4 ranks.

A: 190° C.≦Hot offset-occurring temperature
B: 180° C.≦Hot offset-occurring temperature <190° C.
C: 170° C.≦Hot offset-occurring temperature <180° C.

D: Hot offset-occurring temperature <170° C.

<Deformation Rank of Toner>

A toner sample (1 mg) was placed between two glass slides (S-1111, product of MATSUNAMI Co.). A load of 1 kg was applied onto the glass slides, which were then left to stand at 40° C. and 90% for 3 days. Thereafter, a SEM image of the toner taken out therefrom was used to judge the deformation rank of the toner.

A: No deformation of the toner was observed

B: Slight deformation was observed at the surface of the toner in contact with the glass C: The toner was deformed to form smooth toner surfaces, where voids were observed D: The toner was deformed and fused, involving no voids <Accelerated Aggregation Degree>

Powder tester PT-R (product of Hosokawa Micron Co.) was used to measure the toner for accelerated aggregation degree. The sieve used had a mesh size of 20 μm, 45 μm or 75 μm. The toner samples having left to stand at 25° C. and 50% for 24 hours and at 40° C. and 90% for 24 hours, respectively, were used to measure the accelerated aggregation degrees, the difference between which was evaluated.

A: Difference ≦2.5%

B: 2.5%<Difference ≦5.0%

C: 5.0%<Difference ≦7.5%

D: 7.5%<Difference

<Penetration Degree>

A sample (10 g) was added to a 30 mL screw bottle, which was then placed in a thermostat bath (DK340S). After left to stand at 40° C. and 90% for 24 hours, the sample was taken out and left to cool at room temperature. The thus-treated sample was measured for penetration degree with a penetration tester and evaluated on the basis of the following 4 ranks.

A: 15.0 mm≦Penetration degree

B: 10.0 mm≦Penetration degree <15.0 mm

C: 5.0 mm≦Penetration degree <10.0 mm

D: Penetration degree <5.0 mm

TABLE 1-1

| | First resin | | | Second resin | | | |
|---|---|---|---|---|---|---|---|
| | | | | Fine resin particle | | Volume average particle | |
| | Core resin | Acid value | Tg ° C. | dispersion liquid | Tg ° C. | diameter μm | Amount Parts |
| Ex. 1 | [2] | 12 | 65 | [1] | 84 | 0.122 | 5 |
| Ex. 2 | [3] | 20 | 57 | [1] | 84 | 0.122 | 5 |
| Ex. 3 | [3] | 20 | 57 | [2] | 55 | 0.135 | 5 |
| Ex. 4 | [3] | 20 | 57 | [3] | 61 | 0.117 | 5 |
| Ex. 5 | [3] | 20 | 57 | [4] | 70 | 0.115 | 5 |
| Ex. 6 | [3] | 20 | 57 | [5] | 99 | 0.100 | 5 |
| Ex. 7 | [3] | 20 | 57 | [6] | 75 | 0.113 | 5 |
| Ex. 8 | [3] | 20 | 57 | [7] | 87 | 0.079 | 5 |
| Ex. 9 | [3] | 20 | 57 | [8] | 75 | 0.100 | 5 |
| Ex. 10 | [3] | 20 | 57 | [1] | 84 | 0.122 | 5 |
| Ex. 11 | [4] | 13 | 43 | [1] | 84 | 0.122 | 5 |
| Ex. 12 | [3] | 20 | 57 | [14] | 44 | 0.143 | 5 |
| Ex. 13 | [5] | 45 | 60 | [1] | 84 | 0.122 | 5 |
| Ex. 14 | [3] | 20 | 57 | [15] | 101 | 0.100 | 5 |
| Comp. Ex. 1 | [2] | 21 | 65 | — | — | — | — |
| Comp. Ex. 2 | [2] | 12 | 59 | [9] | 64 | 0.120 | 10 |
| Comp. Ex. 3 | [2] | 12 | 59 | [10] | 101 | 0.300 | 10 |
| Comp. Ex. 4 | [3] | 20 | 57 | [11] | 66 | 0.112 | 5 |
| Comp. Ex. 5 | [3] | 20 | 57 | [1] | 84 | 0.122 | 25 |
| Comp. Ex. 6 | [3] | 20 | 57 | [1] | 84 | 0.122 | 5 |
| Comp. Ex. 7 | [3] | 20 | 57 | [12] | 48 | 0.115 | 5 |
| Comp. Ex. 8 | [3] | 20 | 57 | [13] | 99 | 0.122 | 5 |
| Comp. Ex. 9 | | | | | | | |

TABLE 1-2

| | Toner particles | | | Protrusions | | |
|---|---|---|---|---|---|---|
| | Volume average particle diameter μm | Sphe-ricity | Tg ° C. | Embedment rate % | Standard deviation of embedment rate | Sphe-ricity |
| Ex. 1 | 6.5 | 0.985 | 65.4 | 49 | 8.9 | 0.984 |
| Ex. 2 | 6.3 | 0.986 | 54.6 | 55 | 9.4 | 0.984 |
| Ex. 3 | 6.6 | 0.985 | 54.6 | 61 | 10.4 | 0.981 |
| Ex. 4 | 6.8 | 0.986 | 56.3 | 57 | 14.2 | 0.982 |
| Ex. 5 | 6.7 | 0.980 | 54.5 | 60 | 9.9 | 0.975 |
| Ex. 6 | 7.6 | 0.980 | 55.5 | 42 | 8.5 | 0.980 |
| Ex. 7 | 8.6 | 0.976 | 54.7 | 51 | 12.8 | 0.983 |
| Ex. 8 | 6.7 | 0.980 | 54.7 | 56 | 11.0 | 0.982 |
| Ex. 9 | 6.6 | 0.985 | 54.5 | 52 | 10.1 | 0.983 |
| Ex. 10 | 8.1 | 0.986 | 54.4 | 48 | 8.1 | 0.984 |
| Ex. 11 | 5.5 | 0.985 | 49.2 | 66 | 9.0 | 0.982 |
| Ex. 12 | 6.7 | 0.982 | 55.0 | 42 | 12.2 | 0.983 |
| Ex. 13 | 7.8 | 0.967 | 60.2 | 62 | 13.1 | 0.983 |
| Ex. 14 | 7.5 | 0.981 | 54.7 | 55 | 9.3 | 0.982 |
| Comp. Ex. 1 | 5.7 | 0.986 | 65.9 | — | — | — |
| Comp. Ex. 2 | 7.2 | 0.920 | 66.8 | 2 | 0.4 | 0.985 |
| Comp. Ex. 3 | 7.2 | 0.920 | 67.3 | 6 | 0.6 | 0.986 |
| Comp. Ex. 4 | 8.1 | 0.980 | 57.5 | — | — | — |
| Comp. Ex. 5 | 4.9 | 0.931 | 55.1 | 26 | 15.2 | 0.980 |
| Comp. Ex. 6 | 5.5 | 0.982 | 54.5 | 12 | 3.6 | 0.983 |
| Comp. Ex. 7 | 6.7 | 0.978 | 54.6 | 5 | 0.3 | — |
| Comp. Ex. 8 | 6.7 | 0.986 | 54.7 | 84 | 8.5 | 0.965 |
| Comp. Ex. 9 | 6.9 | 0.987 | 55.5 | 93 | 5.8 | 0.982 |

TABLE 2-1

| | Development | | Transfer | | |
|---|---|---|---|---|---|
| | Background smear | Adhesion resistance | Transfer rate | Transfer uneveness | Cleaning |
| Ex. 1 | A | A | A | A | A |
| Ex. 2 | A | A | A | A | A |
| Ex. 3 | B | A | A | A | A |
| Ex. 4 | B | A | A | A | A |
| Ex. 5 | A | B | A | A | A |

TABLE 2-1-continued

| | Development | | Transfer | | |
|---|---|---|---|---|---|
| | Background smear | Adhesion resistance | Transfer rate | Transfer uneveness | Cleaning |
| Ex. 6 | B | B | A | A | B |
| Ex. 7 | B | A | A | A | A |
| Ex. 8 | B | A | A | A | A |
| Ex. 9 | B | A | A | A | A |
| Ex. 10 | B | A | A | A | A |
| Ex. 11 | B | B | A | A | A |
| Ex. 12 | B | C | B | B | A |
| Ex. 13 | C | B | C | C | A |
| Ex. 14 | A | A | A | A | A |
| Comp. Ex. 1 | D | C | C | C | D |
| Comp. Ex. 2 | D | D | D | D | A |
| Comp. Ex. 3 | D | D | D | D | A |
| Comp. Ex. 4 | D | C | B | D | D |
| Comp. Ex. 5 | D | D | D | D | D |
| Comp. Ex. 6 | D | D | D | D | D |
| Comp. Ex. 7 | D | C | D | D | B |
| Comp. Ex. 8 | B | C | A | A | A |
| Comp. Ex. 9 | D | B | C | C | D |

TABLE 2-2

| | Fixing | | Heat resistance storage stability | | |
|---|---|---|---|---|---|
| | Minimum temperature | Hot offset | Deformation rank | Aggregation degree | Penetration degree |
| Ex. 1 | B | A | A | A | A |
| Ex. 2 | A | A | B | B | B |
| Ex. 3 | A | A | B | B | B |
| Ex. 4 | A | A | B | B | B |
| Ex. 5 | A | A | B | B | B |
| Ex. 6 | A | A | B | B | B |
| Ex. 7 | A | A | B | B | B |
| Ex. 8 | A | A | B | B | B |
| Ex. 9 | A | A | B | B | B |
| Ex. 10 | A | A | B | B | B |
| Ex. 11 | A | C | C | C | C |
| Ex. 12 | A | B | B | C | C |
| Ex. 13 | B | B | A | B | B |
| Ex. 14 | C | A | B | B | B |
| Comp. Ex. 1 | B | A | A | D | C |
| Comp. Ex. 2 | A | A | A | D | D |
| Comp. Ex. 3 | A | A | A | D | D |
| Comp. Ex. 4 | A | A | B | D | D |
| Comp. Ex. 5 | D | A | B | C | B |
| Comp. Ex. 6 | A | A | B | D | D |
| Comp. Ex. 7 | A | A | B | D | D |
| Comp. Ex. 8 | C | A | B | B | C |
| Comp. Ex. 9 | A | A | B | D | D |

Industrial Applicability

The toner of the present invention is excellent in chargeability, developing durability, adhesion resistance, transferability, cleanability, heat resistance storage stability and low-temperature fixing property, and can form high-quality images. Thus, the toner of the present invention is suitable as a toner used in image forming apparatuses such as electronic copiers, printers and facsimiles.

What is claimed is:

1. An electrostatic image developing toner comprising:

toner core particles each containing at least a first resin and a colorant, and fine resin particles formed of a second resin, wherein part of each of the fine resin particles is embedded in each of the toner core particles, and the remaining part of the fine resin particle is exposed on a surface of the toner core particle to form a protrusion, and wherein when a rate of the part of the fine resin particle to the fine resin particle is indicated by an embedment rate, an average of the embedment rates in the fine resin particles is 40% to 80%, wherein a standard deviation of the embedment rates is 10 or less.

2. The electrostatic image developing toner according to claim 1, wherein the fine resin particles have an average sphericity of 0.90 or more.

3. The electrostatic image developing toner according to claim 1, wherein an amount of the fine resin particles is 1% by mass to 20% by mass relative to the electrostatic image developing toner.

4. The electrostatic image developing toner according to claim 1, wherein the first resin is a polyester resin.

5. The electrostatic image developing toner according to claim 1, wherein the first resin has an acid value of 2 mgKOH/g to 25 mgKOH/g.

6. The electrostatic image developing toner according to claim 1, wherein the second resin is a vinyl resin.

7. The electrostatic image developing toner according to claim 1, wherein an amount of a styrene monomer among monomers forming the second resin is 80% by mass to 100% by mass.

8. The electrostatic image developing toner according to claim 1, wherein an amount of an acid monomer among the monomers forming the second resin is 0% by mass.

9. The electrostatic image developing toner according to claim 1, wherein the first resin has a glass transition temperature Tg1 which satisfies expression (1) below:

$$45^\circ\ C. \leqq Tg1 \leqq 70^\circ\ C. \quad (1)$$

10. The electrostatic image developing toner according to claim 1, wherein the second resin has a glass transition temperature Tg2 which satisfies expression (2) below:

$$45^\circ\ C. \leqq Tg2 \leqq 100^\circ\ C. \quad (2)$$

11. The electrostatic image developing toner according to claim 1, wherein the toner core particles each further contain a modified polyester resin containing a urethane group, a urea group or both of the groups.

12. The electrostatic image developing toner according to claim 1, wherein the toner core particles each further contain a releasing agent.

13. The electrostatic image developing toner according to claim 1, wherein the electrostatic image developing toner further contains as an additive fine silica particles whose surfaces have been hydrophobized.

14. The electrostatic image developing toner according to claim 1, wherein the electrostatic image developing toner is obtained through a process including producing the toner core particles, and attaching and fusing the fine resin particles on the surfaces of the toner core particles.

15. The electrostatic image developing toner according to claim 14, wherein the toner core particles are obtained through granulation performed by emulsifying or dispersing, in an aqueous medium, an oil phase containing at least the colorant and the first resin, a precursor of the first resin, or both of the first resin and the precursor.

16. The electrostatic image developing toner according to claim 15, wherein the electrostatic image developing toner is obtained by adding an aqueous dispersion liquid of the fine resin particles to the aqueous medium containing the toner core particles emulsified or dispersed therein, to attach and fuse the fine resin particles to the surfaces of the toner core particles.

17. A toner container comprising:

an electrostatic image developing toner, and a container, which houses the electrostatic image developing toner, wherein the electrostatic image developing toner comprises toner core particles each containing at least a first resin and a colorant, and fine resin particles formed of a second resin, wherein part of each of the fine resin particles is embedded in each of the toner core particles, and the remaining part of the fine resin particle is exposed on a surface of the toner core particle to form a protrusion, and wherein when a rate of the part of the fine resin particle to the fine resin particle is indicated by an embedment rate, an average of the embedment rates in the fine resin particles is 40% to 80%, wherein a standard deviation of the embedment rates is 10 or less.

18. A developer comprising:

an electrostatic image developing toner which comprises toner core particles each containing at least a first resin and a colorant, and fine resin particles formed of a second resin, wherein part of each of the fine resin particles is embedded in each of the toner core particles, and the remaining part of the fine resin particle is exposed on a surface of the toner core particle to form a protrusion, and wherein when a rate of the part of the fine resin particle to the fine resin particle is indicated by an embedment rate, an average of the embedment rates in the fine resin particles is 40% to 80%, wherein a standard deviation of the embedment rates is 10 or less.

* * * * *